US010648146B1

(12) United States Patent
Reulet

(10) Patent No.: US 10,648,146 B1
(45) Date of Patent: May 12, 2020

(54) PRECAST CONCRETE SCREW CYLINDER SYSTEM AND METHOD FOR SOIL STABILIZATION AND EROSION CONTROL

(71) Applicant: Martin Reulet, Vacherie, LA (US)

(72) Inventor: Martin Reulet, Vacherie, LA (US)

( * ) Notice: Subject to any disclaimer, the term of this patent is extended or adjusted under 35 U.S.C. 154(b) by 0 days.

(21) Appl. No.: 16/231,378

(22) Filed: Dec. 21, 2018

Related U.S. Application Data

(60) Provisional application No. 62/610,075, filed on Dec. 22, 2017.

(51) Int. Cl.

| | |
|---|---|
| ***E02B 3/06*** | (2006.01) |
| ***E02D 7/22*** | (2006.01) |
| ***E02D 3/00*** | (2006.01) |
| ***E02D 5/30*** | (2006.01) |
| ***E02D 5/56*** | (2006.01) |
| *E02D 5/52* | (2006.01) |

(52) U.S. Cl.
CPC ..... *E02D 3/00* (2013.01); *E02B 3/06* (2013.01); *E02D 5/30* (2013.01); *E02D 5/56* (2013.01); *E02D 7/22* (2013.01); *E02D 5/52* (2013.01); *E02D 2200/1685* (2013.01); *E02D 2300/002* (2013.01); *E02D 2300/0045* (2013.01); *E02D 2600/20* (2013.01)

(58) Field of Classification Search
CPC .... E02D 3/00; E02D 5/30; E02D 5/36; E02D 7/22; E02D 5/52; E02D 2200/1685; E02D 2300/002; E02D 2300/0045; E02D 2600/20; E02B 3/06
See application file for complete search history.

(56) References Cited

U.S. PATENT DOCUMENTS 3,312,295 A 4/1967 Bodine, Jr.
3,891,037 A 6/1975 Well et al.
(Continued)

OTHER PUBLICATIONS

Carter, Josh; Living Shoreline Demonstration Project; Jan. 2013 (Year: 2013).*

(Continued)

*Primary Examiner* — Benjamin F Fiorello
(74) *Attorney, Agent, or Firm* — Garvey, Smith & Nehrbass, Patent Attorneys, L.L.C.; Julia M. FitzPatrick; Charles C. Garvey, Jr.

(57) ABSTRACT

An earth stabilization system includes a plurality of hollow jars positioned within ground to be stabilized, the jar walls formed from a concrete material or mix. The jars include a base cutter including a plurality of teeth coupled to a jar wall at or near the wall bottom, the base cutter including at least one material other than concrete, e.g., metal, diamond tip or carbide tip. The jars can be coupled to a turning tool that can cause rotation of the jar to turn or drive the jar into the soil mass or waterbed. The turning tool effects rotation of the jar and the base cutter, and the weight of the jar and the base cutter at least in part enable the jar to penetrate the ground to be stabilized. Displaced soil or other earthen material can move through a bore in the wall of the jar while the jar is being screwed into the soil in the direction of the wall bottom to the wall top. The base cutter of each jar can be welded to reinforcing material in a jar wall. The base cutter of each jar can also be included as an integral portion of a single jar unit.

17 Claims, 24 Drawing Sheets

(56) References Cited

U.S. PATENT DOCUMENTS 4,558,744 A * 12/1985 Gibb ..... E21B 33/037 166/222
4,657,441 A * 4/1987 Horvath ..... E02D 5/72 175/402
4,711,598 A 12/1987 Schaaf et al.
4,801,221 A * 1/1989 Capron ..... E02B 3/06 405/21
5,137,394 A 8/1992 Tateno et al.
5,338,131 A 8/1994 Bestmann
5,380,124 A 1/1995 Cacossa et al.
5,536,112 A * 7/1996 Oertel, II ..... E02B 3/06 405/21
5,697,736 A 12/1997 Veazey et al.
5,778,622 A * 7/1998 Baker ..... E02D 17/205 264/275
6,048,139 A 4/2000 Donovan, III
6,129,163 A * 10/2000 Hamilton ..... E21B 10/02 175/320
6,142,712 A 11/2000 White et al.
6,675,919 B2 1/2004 Mosing et al.
6,786,675 B1 9/2004 Detiveaux
7,413,035 B1 * 8/2008 Miller ..... E21B 7/201 175/171
7,914,236 B2 3/2011 Neville
8,226,325 B1 7/2012 Pierce, Jr.
8,459,381 B2 * 6/2013 Pearce ..... E21B 10/02 175/403
8,985,896 B2 3/2015 Pierce, Jr.
9,157,204 B2 10/2015 Pierce, Jr.
9,410,299 B2 8/2016 Pierce, Jr.
9,732,491 B2 8/2017 Pierce, Jr.
10,344,441 B2 * 7/2019 GangaRao ..... E02D 5/56
2009/0127858 A1 5/2009 Houser et al.
2009/0129870 A1 * 5/2009 Jones ..... E02D 13/04 405/228

OTHER PUBLICATIONS

Field Manual No. 5-134, "Pile Construction", Headquarters, Department of the Army Washington, DC, Apr. 18, 1985.
"Restoring 'Living Shorelines'", National Precast Concrete Association / Precast Magazines / Precast Solutions Magazine / 2011—Summer / Restoring 'Living Shorelines' (Sep. 8, 2011) (available at http://precast.org/2011/09/restoring-%E2%80%98living-shorelines%E2%80%99/ (last visited Aug. 14, 2017).
4—Marine Works (downloaded on Aug. 14, 2017).
Images of shoreline walls (saved on Aug. 14, 2017).

* cited by examiner

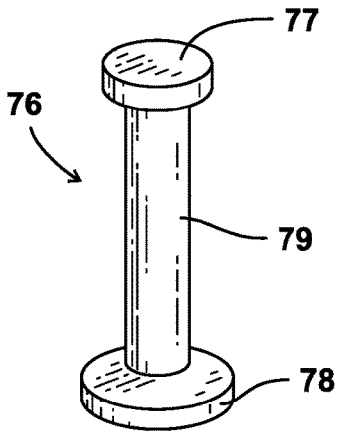
FIG. 23A
FIG. 23B
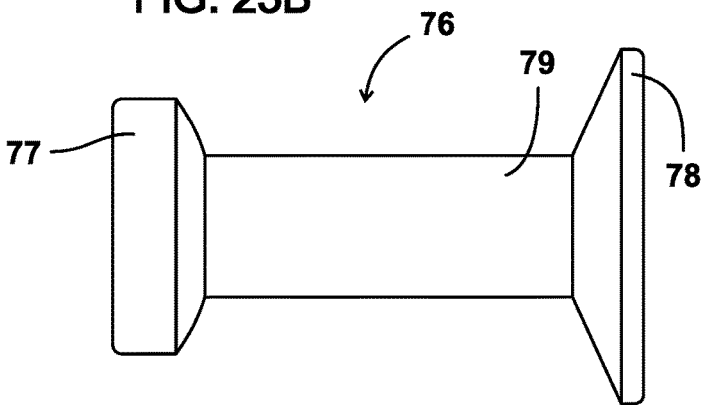
FIG. 23C
DB-52 MB DOGBONE ANCHOR CAPACITIES WHEN USED IN FACE OF FLAT SLAB
| Anchor Size | Concrete Strength | | | | Edge Distance Tension (in) | Edge Distance Shear (in) |
|---|---|---|---|---|---|---|
| | 1500 PSI | 2500 PSI | 3500 PSI | 5000 PSI | | |
| 1T x 2-1/2 | 1600 | 2000 | 2000 | 2000 | 5 | 12 |
| 1T x 3-3/8 | 1900 | 2000 | 2000 | 2000 | 7 | 12 |
| 1T x 4-3/4 | 2000 | 2000 | 2000 | 2000 | 10 | 12 |
| 2T x 2-3/16 | 1550 | 1900 | 2350 | 2800 | 5 | 12 |
| 2T x 3-3/8 | 2100 | 2700 | 3250 | 3900 | 7 | 12 |
| 2T x 4-3/4 | 3250 | 4000 | 4000 | 4000 | 10 | 15 |
| 2T x 5-1/2 | 4000 | 4000 | 4000 | 4000 | 11 | 17 |
| 2T x 6-3/4 | 4000 | 4000 | 4000 | 4000 | 11 | 17 |
| 2T x 11 | 4000 | 4000 | 4000 | 4000 | 11 | 17 |
| 4T x 3-3/4 | 2550 | 3250 | 3950 | 4700 | 8 | 12 |
| 4T x 4-1/4 | 3000 | 3850 | 4550 | 5450 | 9 | 13 |
| 4T x 4-3/4 | 3650 | 4700 | 5600 | 6700 | 10 | 15 |
| 4T x 5-1/2 | 4550 | 5850 | 6950 | 8000 | 11 | 17 |
| 4T x 7-1/8 | 6900 | 8000 | 8000 | 8000 | 15 | 22 |
| 4T x 9-1/2 | 8000 | 8000 | 8000 | 8000 | 19 | 29 |
| 4T x 13-3/8 | 8000 | 8000 | 8000 | 8000 | 19 | 29 |
| 8T x 4-3/4 | 4050 | 5200 | 6200 | 7450 | 10 | 15 |
| 8T x 6-3/4 | 7000 | 9000 | 10750 | 12850 | 14 | 21 |
| 8T x 10 | 11450 | 14750 | 16000 | 16000 | 20 | 30 |
| 8T x 13-3/8 | 16000 | 16000 | 16000 | 16000 | 27 | 41 |
| 16T x 9-7/8 | 11750 | 15150 | 17950 | 21500 | 20 | 30 |
| 16T x 19-5/8 | 32000 | 32000 | 32000 | 32000 | 40 | 48 |

PRECAST CONCRETE SCREW CYLINDER SYSTEM AND METHOD FOR SOIL STABILIZATION AND EROSION CONTROL

CROSS-REFERENCE TO RELATED APPLICATIONS

The benefit of and/or priority to U.S. Provisional Patent Application Ser. No. 62/610,075, filed on 22 Dec. 2017, which is hereby incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

An apparatus, system and method for earthen stabilization and erosion control, while giving a natural look to the surrounding landscape, are provided. In particular, what is provided is an apparatus, system and method for earthen stabilization, e.g., for use in soil, sand, sediment, clay and/or other earthen or ground material. The soil stabilization apparatus, system and method preferably include a plurality of concrete jars, concrete piles, or other similar units, that include a base cutter portion. A base cutter portion can be made from a material other than concrete, e.g., metal or diamond tipped, and can be coupled to the concrete pile or jar. The piles or jars can be turned, rotated, driven or screwed into an earthen surface, e.g., a waterbed or soil, to be stabilized. A pile or jar can be completely buried in the earthen material or can have a top portion extending above the earthen material. If a top portion extends above the earthen material, it can be sloped or truncated to match the natural slope of the surrounding environment. A pile or jar top portion can include one or more openings in which natural or synthetic material can be positioned or placed, e.g., for blending the pile or jar with the natural surrounding environment and landscape.

2. General Background of the Invention

In the field of soil stabilization and/or erosion control, typically units are placed on top of a ground or earthen surface next to a waterway or along a shore of a waterway. The problem with units that are placed on top of a ground or earthen surface, e.g., on soil or sand or in a marsh area, is that they are limited in stability against wave action. The units will move or become displaced. Also, when placing on natural, not level or soft soils, or other soft earthen material, problems arise with differential settlement. Units begin to sink and structures lean over and do not hold in an upright position, which leads to failure of the structure's original and/or intended purpose.

Bell shaped or spread bottom units have been used in the prior art, which can provide more stability to prevent the units from sinking into the ground, but the bell shape or spread bottom prevents units from being placed close to one another and keeping of a vertical alignment. Fabric is sometimes placed below units in the prior art to help prevent sinking.

Also, the prior art units that are used for erosion control are typically made of plastic, PVC, or metal materials having thin walls, e.g., ⅛ inch to 1 inch thickness.

There is a need in the art for a soil stabilizer and erosion protection device, system and/or method that can use the natural soil, ground, or other earthen material to give stability against wave action.

There is also a need in the art for a soil stabilizer and erosion protection device, system and/or method that eliminate the problem of turning over of units and differential settlement of units.

There is also a need in the art for a soil stabilizer and erosion protection device that can prevent scouring in front of the piles or jars.

There is also a need for a system and method where tops of units can be placed level with the waterline or landscape and remain plumb and level, supported by the skin friction of the soil, loam, sand and/or other earthen material on both the exterior and interior of pile jars.

The following U.S. patents and patent application publications are hereby incorporated herein by reference thereto: U.S. Pat. Nos. 3,312,295; 3,891,037; 4,711,598; 5,137,394; 5,338,131; 5,380,124; 5,697,736; 6,048,139; 6,142,712; 6,675,919; 6,786,675; 7,914,236; 8,985,896; 9,410,299; and US2009/0127858.

The Field Manual No. 5-134, "PILE CONSTRUCTION", Headquarters, Department of the Army Washington, D.C., 18 Apr. 1985 (available at ftp://ftp.odot.state.or.us/techserv/geo-environmental/Biology/Hydroacoustic/References/Literature%20references/USACE%20Field %20Manual %20for%20Pile%20Construction.pdf) is hereby incorporated herein by reference.

"Restoring 'Living Shorelines'", National Precast Concrete Association/Precast Magazines/Precast Solutions Magazine/2011—Summer/Restoring 'Living Shorelines'/Restoring 'Living Shorelines' (Sep. 8, 2011) (available at http://precast.org/2011/09/restoring-%E2%80%98living-shorelines%E2% 80%99/) is hereby incorporated herein by reference.

4—Marine Works (http://tycnw01vtc.edu.hk/cbe2024/4-Marine.pdf) is hereby incorporated herein by reference.

BRIEF SUMMARY OF THE INVENTION

The apparatus, system and method of the present invention solve the problems confronted in the art in a simple and straightforward manner. What is provided is an earth stabilization system, preferably comprising a plurality of hollow members, e.g., hollow piles or jars, positioned within the ground, soil mass, or earth surface to be stabilized. Preferably, a member, jar or pile that is used in one or more preferred embodiments of the system and/or method is hollow.

Each hollow member, e.g., a jar or pile, can be a precast concrete jar or pile including reinforcing material in the walls of the concrete jar or pile. A jar or pile can also be formed with other types of precast material that can harden to a stone-like material. A cutter portion can be coupled to a base of a jar or pile after a jar or pile is fabricated. A cutter portion can also be fabricated as an integral part of the jar or pile, e.g., included in a form and coupled to reinforcing material and/or coupled within concrete poured into the form.

A hollow member, e.g., a pile or jar, can be driven or screwed or turned into the soil, seabed, waterbed or other ground or earthen material to be stabilized until the hollow member is completely buried in the soil, seabed, waterbed or other ground or earthen material.

Alternatively, a hollow member, e.g., a pile or j ar, can have a top/upper portion extending above the soil, seabed, waterbed or other ground or earthen material to be stabilized. If a top/upper portion extends above the soil, seabed, waterbed or other ground or earthen material to be stabilized, it can be sloped or truncated to match the natural slope of the ground or earth surface or of the surrounding landscape or environment, or to blend in with the surrounding landscape and environment.

A top/upper portion extending above the soil, seabed, waterbed or other ground or earthen material to be stabilized can be integral with the hollow member. A top/upper portion extending above the soil, seabed, waterbed or other ground or earthen material to be stabilized can be integral with the hollow member and have a top surface that is substantially level. A top/upper portion extending above the soil, seabed, waterbed or other ground or earthen material to be stabilized can be integral with a hollow member and sloped.

A top/upper portion extending above the soil, seabed, waterbed or other ground or earthen material to be stabilized can be a separate top/upper extension portion that is coupled to a hollow member. A top/upper portion extending above the soil, seabed, waterbed or other ground or earthen material to be stabilized can be a separate top/upper extension portion that is coupled to a hollow member, and wherein the top/upper extension portion is sloped or substantially straight. A top/upper portion extending above the soil, seabed, waterbed or other ground or earthen material to be stabilized can be a separate top/upper extension portion that is coupled to a hollow member, and wherein the top/upper extension portion has a substantially level top surface. A top/upper portion extending above the soil, seabed, waterbed or other ground or earthen material to be stabilized can be a separate top/upper extension portion that is coupled to a hollow member, and wherein the top/upper extension portion is not sloped.

In one or more embodiments, when an upper portion of a hollow member extends above the soil, seabed, waterbed or other ground or earthen surface, a top extension portion can be coupled to the hollow member. The top extension portion can be sloped or not sloped.

A top/upper portion, whether integral with the hollow member or a separate component, can include one or more openings in which natural or synthetic material, e.g., plant material or rocks or shells or earthen material, can be positioned, for blending the hollow member with a natural landscape, waterbed or earthen surface.

In one or more embodiments of the present invention, an earth stabilization system can be included in tidal areas wherein wave action or water may sometimes contact the earth stabilization system during tidal changes.

In one or more embodiments of the system and/or method, the hollow member, e.g., piles or jars, are preferably driven into the soil or other earthen material to a sufficient depth to give stability to the system against wave action and also to stabilize the soil or other earthen material. The hollow member, piles or jars can be driven into the soil or other earthen material to a depth at which they are completely covered by the soil or other earthen material, or so that only an upper portion of the hollow member, pile or jar is above the ground or earth surface, e.g., one to 3 feet above the ground or earth surface. When the hollow member, pile or jar is driven into the soil or earthen material as discussed, the system and method prevent the problem of turning over of units and of differential settlement from arising. The hollow member, piles or jars or other similar units can be placed into the soil mass or other earthen material at least substantially level and straight, and this position can be maintained even with wave action contacting an area of the system.

In one or more embodiments in which a top portion of a pile or jar is sloped, this can help prevent scouring of soil in front of the piles or jars, by providing a slope that corresponds to, or is similar to, the natural slope of the land or earth surface.

A hollow member can be a hollow pile or a hollow jar.

A pile can be a drive pile or drive cylinder.

A pile can be a screw pile or screw cylinder.

A hollow member, e.g., a pile or jar, can include a cutter portion. A cutter portion can be a base cutter located at or near a bottom of the hollow member.

A base cutter can include a plurality of teeth.

A base cutter can include a plurality of cutting members.

A base cutter can be coupled to reinforcing material of a hollow member, pile or jar wall at or near a hollow member, pile or jar bottom.

A base cutter can include a stud coupled thereto, e.g., welded or mechanically fastened. A stud can also be formed integral with a base cutter. Concrete can be poured into a form including the base cutter with the stud coupled thereto, with the stud securing the base cutter within the concrete of the pile.

The base cutter can have a toothed cutting bottom portion that is part of a side wall of a hollow member, jar or pile.

The base cutter can have a toothed cutting bottom portion that is part of a side wall of a hollow member, jar or pile and fabricated with the same concrete mix, composite mix, or other material that is used to form a sidewall of the jar or pile.

In some embodiments, e.g., when stabilizing harder soil masses, a base cutter preferably includes at least one material other than concrete or composite material.

In some embodiments, e.g., when stabilizing a loose or soft soil mass, e.g., in a marsh area, a base cutter does not need to include a material other than concrete or composite material.

A top or upper portion of a hollow member, pile or jar preferably can be coupled to a turning tool, e.g., a drive unit, that can cause rotation of the hollow member, pile or jar. Rotation of a hollow member, pile or jar, including rotation of a base cutter, enables the hollow member, pile or jar to be screwed or turned or driven into the soil or earthen material, wherein the turning tool or drive unit effects rotation of the hollow member, pile or jar and of the base cutter, and wherein the base cutter and weight of the hollow member, pile or jar enable the hollow member, pile or jar to penetrate the soil or earthen material, to a desired distance within the soil or earthen material.

When driving or screwing a hollow member, pile or jar into earthen material, displaced earthen material can move through an opening or bore in the hollow member, pile or jar bottom, while the hollow member, pile or jar is being screwed into the earthen material, in the direction of the bottom to the top of the hollow member, pile or jar.

In various embodiments, the hollow member, pile or jar can be a precast concrete screw cylinder.

In various embodiments, the system and method of the present invention can be used for earthen stabilization and protection.

In various embodiments, the system and method of the present invention can be used for shoreline stabilization and protection.

In various embodiments, a hollow member, pile or jar can include a truncated top.

In various embodiments, a hollow member, pile or jar can include a sloped top portion.

In various embodiments, a hollow member, pile or jar can include an at least substantially level top portion.

In various embodiments, a hollow member, pile or jar can include a truncated top having a slope that matches the natural slope of a shoreline.

In various embodiments, a hollow member, pile or jar can include a truncated top having a slope that closely conforms to the natural slope of a shoreline.

In various embodiments, a hollow member, pile or jar can include a truncated top that can absorb the energy of waves, and/or effect wave attenuation and dissipation.

In various embodiments, the top portion of a hollow member, pile or jar can be substantially flat or level.

In various embodiments, one or more hollow members, piles or jars used in the system and/or method can be of variable heights.

In various embodiments, one or more hollow members, piles or jars used in the system and/or method can be stackable and/or connectable.

In various embodiments, one or more extension units of a hollow member, pile or jar can be stackable or connectable.

In various embodiments, the height of a hollow member, pile or jar and/or depth to which a hollow member, pile or jar is driven into the earth can be selected to maximize stability of the units based on wave action in the area.

In various embodiments, the height of one hollow member, pile or jar and/or depth to which a hollow member, pile or jar is driven into the earth can be different from the height of another hollow member, pile or jar and/or depth to which another hollow member pile or jar is driven into the earth.

In various embodiments, one or more hollow members, piles or jars used in the system and/or method can have variable diameters. For example, the diameter of a hollow member, pile or jar or other similar unit used in the system and/or method can be about 24"-144" (24 inches to 144 inches) in diameter.

In various embodiments, one or more hollow members, piles or jars used in the system and/or method can have variable wall thicknesses. For example, the wall thickness of a hollow member, pile or jar or other similar unit used in the system and/or method can be about 3 to 14 inches.

In various embodiments, one or more hollow members, piles or jars or other similar units used in the system and/or method can include multiple reinforcing materials such as reinforcing bars ("Rebar") wire mesh, steel/glass/carbon fibers and/or other desired reinforcing materials.

In various embodiments, one or more hollow members, piles or jars used in the system and/or method can include various types and styles of base cutters. A base cutter of one or more hollow members, piles or jars used in the system and/or method can include steel or other metal that is carbide tipped or diamond tipped, all types of metal, a combination of one or more of concrete/steel/metal/diamond/epoxy/glass, and/or one or more different combinations of the aforementioned materials.

In various embodiments, one or more hollow members, piles or jars used in the system and/or method can include hard or soft truncated tops. A soft top can be made of natural or synthetic materials, e.g., natural fibers such as straw, wood and rice fibers, or synthetic materials such as geotextile materials. A hard top can be made of cementious materials. A hard top can also be made of fiber glass or composite materials. Other materials, e.g., straw blankets, straw wattles, silt and compost socks, wave screens and matting can be fastened to tops either around the perimeter of the jars, cylinders, or piles, or across the jars, cylinders, or piles, to enhance wave attenuation and/or wave dissipation.

In various embodiments of one or more hollow members, piles or jars or other similar units used in the system and/or method, the hollow members, piles or jars or other similar units can include holes or orifices that can be placed anywhere along the sides of, or an outer perimeter of, and/or along a top portion of a hollow member, pile or jar or other similar unit.

In various embodiments, a base cutter and/or a truncated top can be fastened to a pile, jar or other similar unit by mechanical fasteners, e.g., tie pins.

In various embodiments, one or more base cutter portions used in the system and/or method can be fastened to a hollow member, pile, jar or other similar unit by pouring into concrete, or pouring into some other flowable material that will harden.

In various embodiments, one or more hollow members, piles or jars or other similar units used in the system and/or method can be placed in a straight line or in a curved line. A staggered pattern or gaps between structures can be included as desired, per project design.

In various embodiments, one or more hollow members, piles or jars or other similar units used in the system and/or method can be placed in multiple rows to increase width.

In various embodiments, one or more hollow members, piles or jars or other similar units used in the system and/or method can be filled or topped with various materials, e.g., rock, sand, plant vegetation or synthetic materials.

In various embodiments, a special concrete mix, e.g., that can support marine life, can be used to form one or more hollow members, piles or jars or other similar units. For example, a concrete mix that will encourage oyster growth can be used for one or more piles, jars or other similar units.

In various embodiments, Portland cement concrete can be used for one or more hollow members, piles or jars or other similar units and/or for one or more top or extension portions.

In various embodiments, polymer concrete and/or polymer-modified concrete materials can be used to form one or more hollow members, piles or jars or other similar units and/or for one or more top or extension portions used in the system.

In various embodiments, one or more hollow members, piles or jars or other similar units used in the system and/or method can be of a material other than concrete. For example, a pile or jar or other similar unit could be made of fiberglass material or a composite material. In some embodiments, e.g., if fiberglass is used, reinforcing bars or materials in the hollow member, pile or jar walls may not be needed or desired.

In various embodiments, a crane, or other similar machinery, can be used with a hydraulic device to rotate a hollow member, pile, jar or other similar unit and act as a core bit.

In various embodiments, a crane can be used along with a turning tool or drive unit coupled to a hollow member, pile, jar or other similar unit to rotate the hollow member, pile, jar or other similar unit and act as a core bit.

In various embodiments, a hollow member, pile, jar or other similar unit can include a notched interior wall that can lift, move or displace interior soils when in circular motion while driving the hollow member, pile, jar or other similar unit into the soil.

In various embodiments, a hollow member, pile, jar or other similar unit can include a notched interior wall that can facilitate lifting, moving or displacing interior soils when in circular motion while driving the hollow member, pile, jar or other similar unit into the soil.

In various embodiments, a hollow member, pile, jar or other similar unit can include a spiral notched interior wall that can lift, move or displace interior soils or earthen material when in circular motion while driving the hollow member, pile, jar or other similar unit into position in the soil.

In various embodiments, a hollow member, pile, jar or other similar unit can include a spiral notched interior wall that can facilitate lifting, moving or displacing interior soils or earthen material when in circular motion while driving the hollow member, pile, jar or other similar unit into position in the soil.

In various embodiments, a hollow member, pile, jar or other similar unit can include a structure, e.g., plastic or metal, coupled to an interior wall for helping to move or displace interior soils or earthen material when in motion while driving a hollow member, pile, jar or other similar unit into position in the soil or earthen material.

In various embodiments, a hollow member, pile or jar or other similar unit, which can be a concrete pile or jar, is placed into the soil, sand, ground, or earthen material to a desired depth, e.g., 4 feet deep, or 1 to 8 feet deep, with the top portion of the pile or jar just beneath the surface, hidden from view. The land helps provide stability to the units.

The top portion of a hollow member, pile or jar or other similar unit can also extend above the soil, ground or earth surface. Top sections of various structures can be added to the top of hollow member, jars, piles or other similar units to blend in with the environment, to build secretion sediment, or to provide wave protection.

Preferably the hollow member, piles or jars or other similar units are of a larger size and can span longer distances than piles or other units that are used in the prior art, and this can help lower lineal footage cost. Hollow members, piles or jars can be, for example, about 24" to 144" (24 to 144 inches) in diameter with a wall thickness of about 3" to 14" (3 to 14 inches).

In various embodiments a hollow member, pile or jar or other similar unit can have a wall thickness that is over 1" (one inch).

In various embodiments a hollow member, pile or jar or other similar unit can be turned into soil or other earthen material using a crane with a mechanical device, e.g., made up of gears and chains, using the hollow member's, pile's or jar's or other similar unit's weight along with the base cutter to penetrate the soil or the other earthen material until the hollow member, pile or jar or other similar unit is positioned at a desired depth in the soil or other earthen material.

The top of a hollow member, pile or jar or other similar unit can be flat or sloped and/or can vary in shape.

Hollow members, piles or jars or other similar units used in one or more preferred embodiments of the system and method preferably have a large length size, e.g., about 2 to 12 feet (2' to 12') long, or in height, and can have variable wall thicknesses, e.g., wall thickness of about 3" to 14" (three to fourteen inches). In some embodiments more than one pile or jar or other similar unit can be coupled together to extend the height of a pile or jar or other similar unit if desired, e.g., for deeper applications.

Multiple reinforcing materials such as reinforcing bars ("Rebar"), wire mesh, fibers and other materials can be included in concrete hollow members, piles or jars or extension portions.

A connectable base cutter can be made of steel, carbide tip and diamond tip, or a combination of concrete, steel and diamond introduced into a concrete pour.

In various embodiments of the method and system, hollow members, piles or jars can be placed in a single row with allowable spacing between jars, per project design, e.g., about 6 to 72 inches. In various embodiments, the distance between piles can be at or about 6 inches to about ½ the length of the diameter of a pile or jar.

Various concrete mix designs can be utilized in the system and method.

Various composite mix designs can be utilized in the system and method.

A notched interior wall design can be included in a hollow member, pile or jar, which can help lift, move and/or displace interior soils when in a turning motion.

One or more hollow members, piles or jars used in one or more preferred embodiments of the system and method can vary in length, diameter, and wall thickness.

In various embodiments, the height of a hollow member, pile or jar can be changed or adjusted. In some embodiments, a second pile or jar can be coupled to a first pile or jar, e.g., with a pin and slotted lock mechanism. In various embodiments one, two, three, four or more pile or jar units can be coupled together. In various embodiments one or more additional pile or jar units can be coupled to an original pile or jar unit that has already been driven into the ground, for example, to drive the pile or jar to a greater depth or to extend above the surface.

In various embodiments, tops of a hollow member, pile or jar or other similar units can be placed level with the waterline or landscape and remain plumb and level supported by the skin friction of the soils on both the exterior and interior of pile jars.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIGS. 23A and 23B illustrate a preferred embodiment of a lift anchor, e.g., a DogBone Anchor, that can be used in one or more preferred embodiments of the inventions as described herein; and FIG. 23C is a table including lifting capacities of a DB-52 MB DogBone Anchor.

DETAILED DESCRIPTION OF THE INVENTION

Figure 1A:
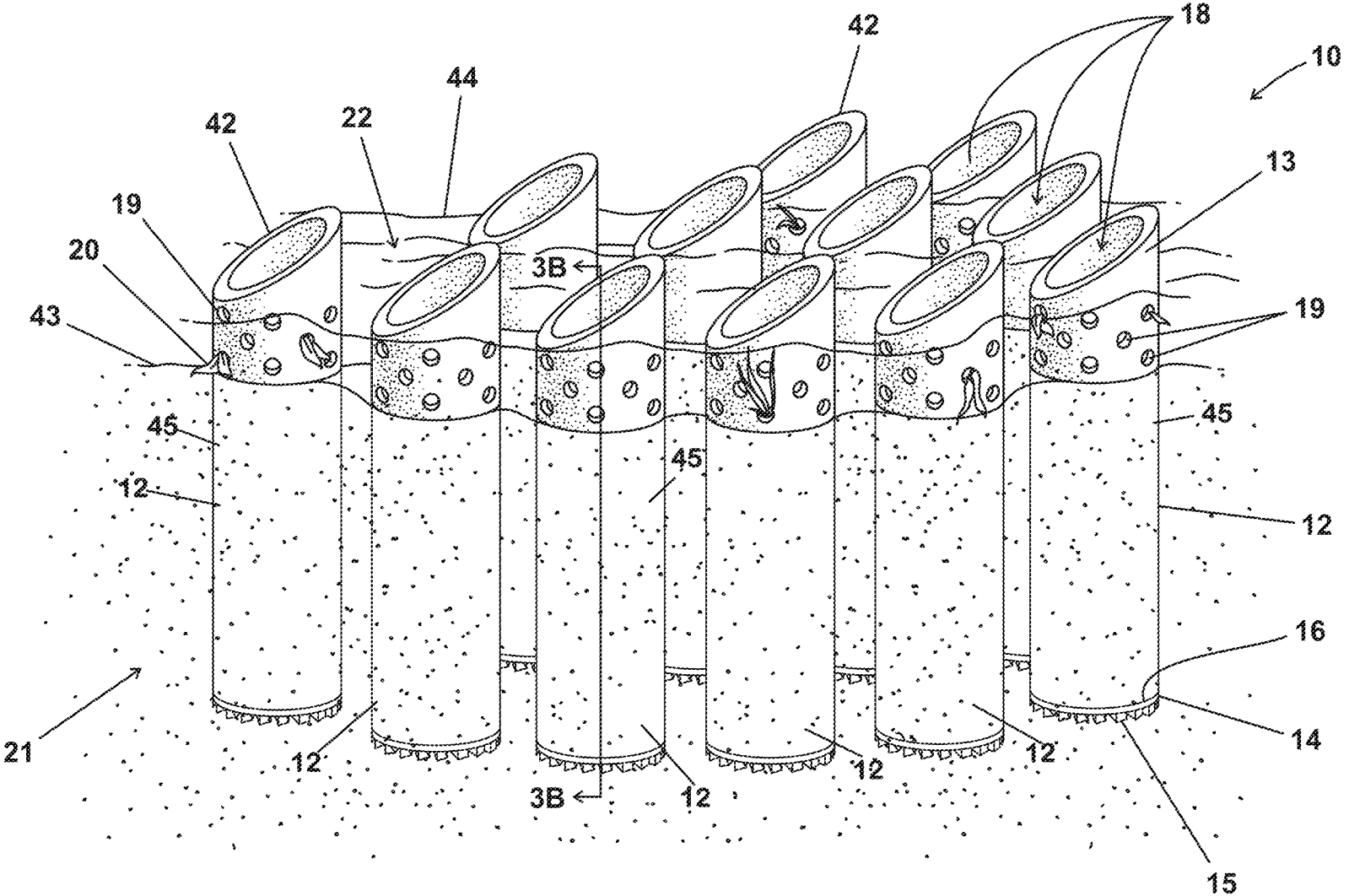
FIGS. 1A and 1B are perspective views of first preferred embodiments of an earth stabilization system of the present invention including hollow members having sloped upper portions.
Figure 1B:
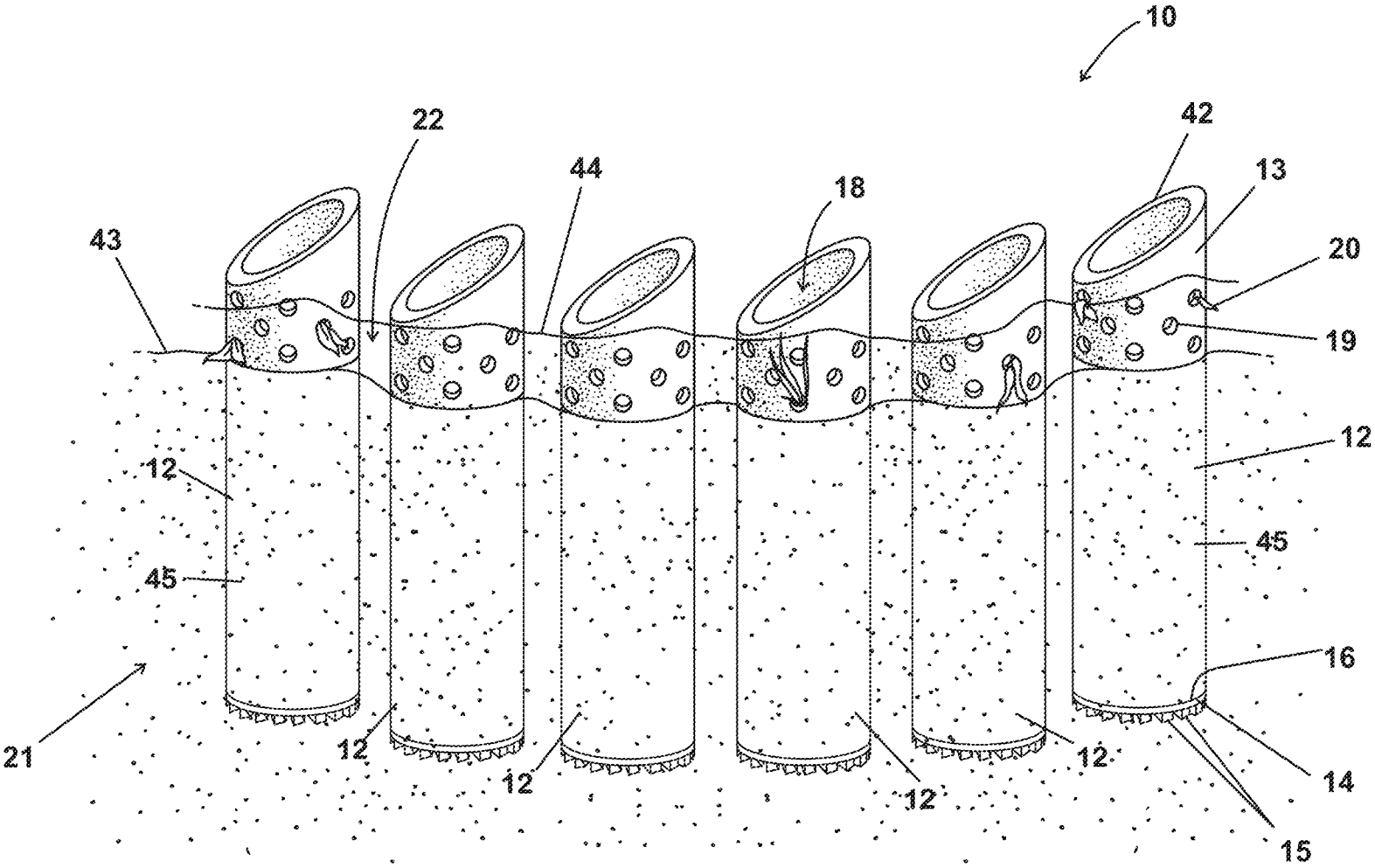

FIGS. 1A-1B illustrate first preferred embodiments of a soil stabilization system designated generally by the numeral 10. A soil stabilization system 10 may also sometimes be referred to herein as an earth/ground stabilization system. Soil stabilization system 10 includes a plurality of hollow members 12, which can be piles or jars. In FIG. 1A, a plurality of hollow members 12 are positioned in a plurality of rows. In FIG. 1B, a plurality of hollow members 12 are positioned in a single row.

Figure 3A:
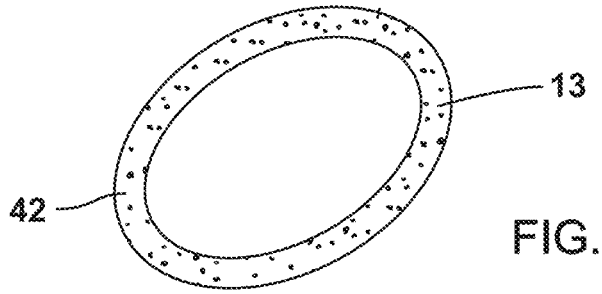
FIG. 3A is a top view of a first preferred embodiment of a hollow member of the present invention as shown in FIG. 1A.
Figure 3B:
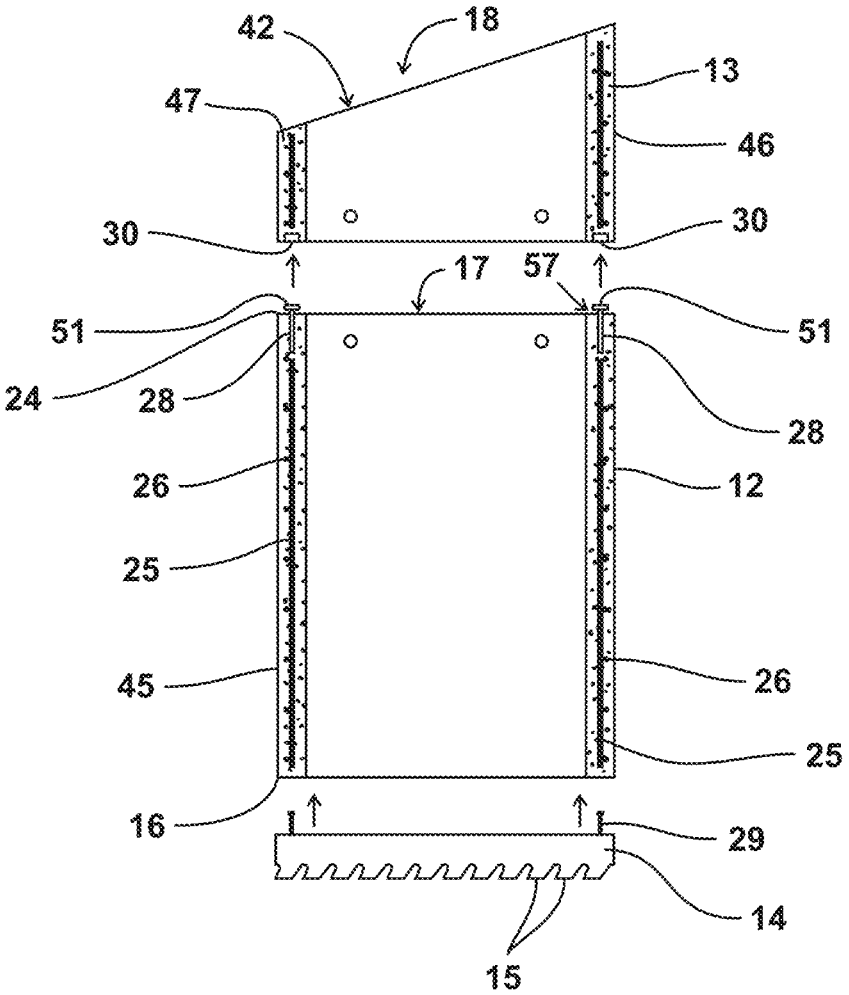
FIG. 3B is an exploded view of a first preferred embodiment of a hollow member of the present invention taken along lines 3B-3B of FIG. 1A.

A hollow member 12 has an upper portion/top 24 and a wall/sidewall 45 (see, for example, FIG. 3B). An extension portion 13, which also may sometimes be referred to herein as an extension or a top portion, can be coupled to upper portion/top 24 of hollow member 12. Extension portion 13 can be truncated or sloped as shown in FIGS. 3A-3B. In other embodiments, an extension portion or top portion that can be coupled to a hollow member 12 can have an upper/top surface that is substantially flat or level (e.g., see extension portion/extension/top portion 67 in FIG. 22A). One or more extension portions 67 can also be used in a soil stabilization system 10 instead of extension portions 13. One or more hollow members 12 with an extension portion 13, and one or more hollow members 12 with an extension portion 67 can also be used together in a soil stabilization system 10.

Figure 15:
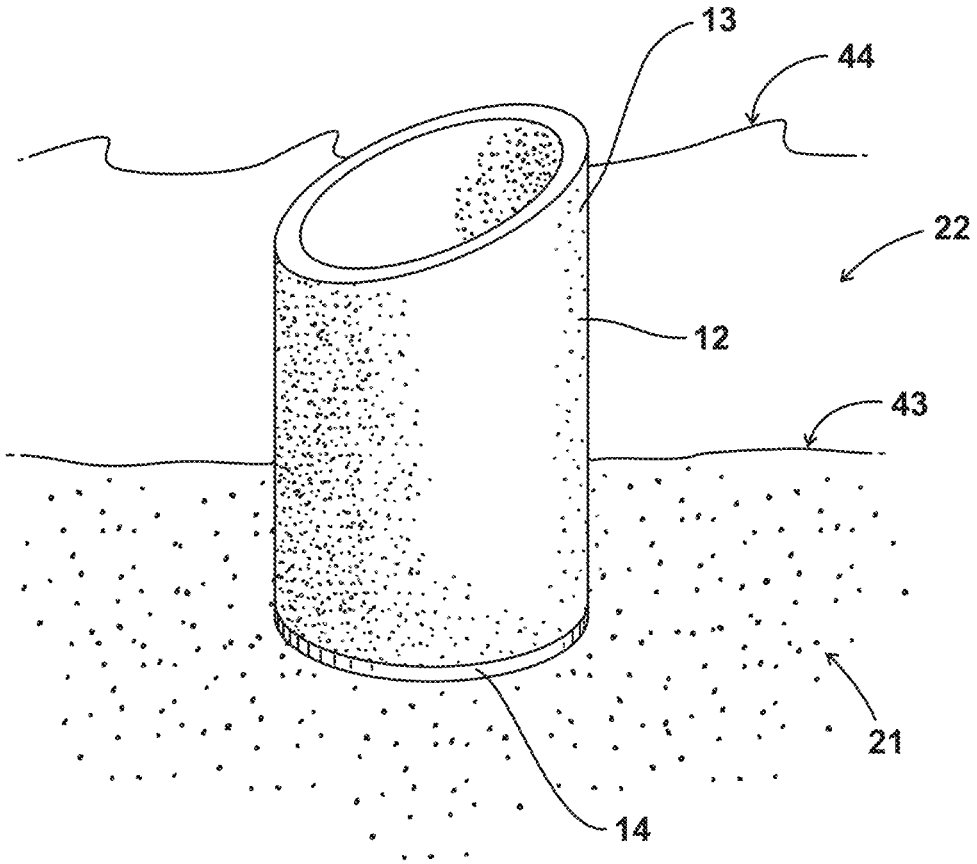
FIG. 15 is a perspective view of a hollow member of the present invention driven into the ground, with a top portion extending into water, which can be used in one or more preferred embodiments of the system and method of the present invention.

A hollow member 12 preferably includes a base cutter portion 14 coupled to a bottom 16 of hollow member 12. Base cutter portion 14 can include a plurality of teeth 15 or other protrusions that can function as cutters to break or cutaway soil or other ground or earth material. As shown in FIGS. 1A and 1B, hollow members 12 can be driven in and positioned within soil mass 21 (which can be ground material, earthen material, a seabed, or a waterbed), to a desired depth, e.g., 1 to 12 feet below surface 43 (which can be a soil mass surface, ground surface, seabed surface, waterbed surface, or other earth surface), and preferably 4 to 12 feet below surface 43. Extension portion 13 can extend a desired distance above surface 43, e.g., 1 to 3 feet (or higher if desired) above surface 43. Extension portion 13 can also extend through or into water 22, above or below a water surface 44 (see, for example, FIGS. 1A-1B, and 15).

A hollow member 12 with or without a top or extension portion 13 can be positioned in soil mass 21. A hollow member 12, with or without a top or extension portion 13 can be positioned along a shoreline, and not within water 22. A hollow member 12, with or without a top or extension portion 13, can also be positioned in a tidal area.

As shown in FIG. 1A, an extension portion 13 can include a plurality of openings or holes 19, which can be generally circular or any other desired shape, e.g., oval, square, rectangular or an irregular shape. An extension portion 13 can also have a wall that does not include holes or openings 19. In a soil stabilization system 10, one or more extension portions 13 can include holes or openings 19, while one or more other extension portions 13 do not include holes or openings 19. A plurality of holes or openings 19 may also be included on walls 45 of hollow members 12, if desired.

Vegetation 20, which can be natural or synthetic vegetation, can be included in holes or openings 19. Gravel, rock, sand, sediment or other desired natural or synthetic material can also be included within a hollow opening or substantially central bore/borehole 18 of extension portion 13. If positioned within water 22, water 22 carrying sediment can flow through holes or openings 19 in extension portion 13 and be deposited within central bore 18 of top/extension portion 13 or flow through extension portion 13 to the other side of extension portion 13. Sediment can also pass between one or more hollow members 12 and be deposited on a rear side of hollow members 12, when hollow members 12 are positioned apart from one another, e.g., spaced a distance apart.

Figure 22A:
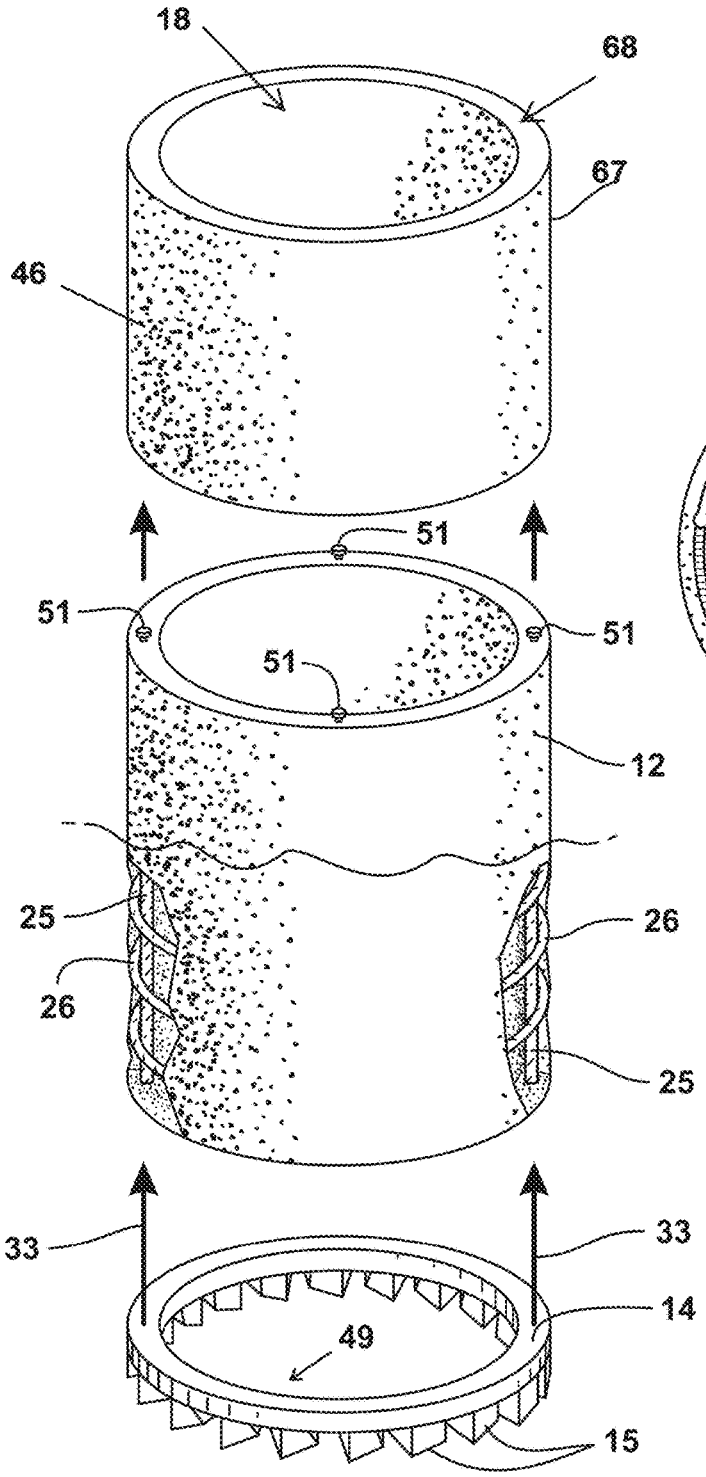
FIG. 22A is an exploded view of a hollow member as shown in FIG. 4A but with a level extension portion, which can be used in one or more preferred embodiments of the system and method of the present invention.

An extension portion 13 can be truncated, and include a slope or sloped portion 42 as shown in FIG. 1A. Alternatively an upper portion of an extension portion 13 can be the same or similar to the top portion 24 of a hollow member 12. In FIG. 22A, a top or extension portion 67 is shown, with a substantially level or flat upper portion/top 68, which can be the same or similar to the top portion 24, 71 of a hollow member 12, 50. Sloped portion 42 can be fabricated to correspond to a slope or natural grade of a surface 43 of the earth, e.g., of a soil surface, ground surface, shore surface, seabed surface or waterbed surface along which the hollow members 12 with a truncated top or extension portion 13 are positioned. This can help hollow members 12 with a top or extension portion 13 coupled thereto blend in with the surrounding natural landscape, waterbed or environment. A sloped portion 42 can also help prevent soil displacement, due to wave action for example, in front of a top or extension portion 13.

Figure 2A:
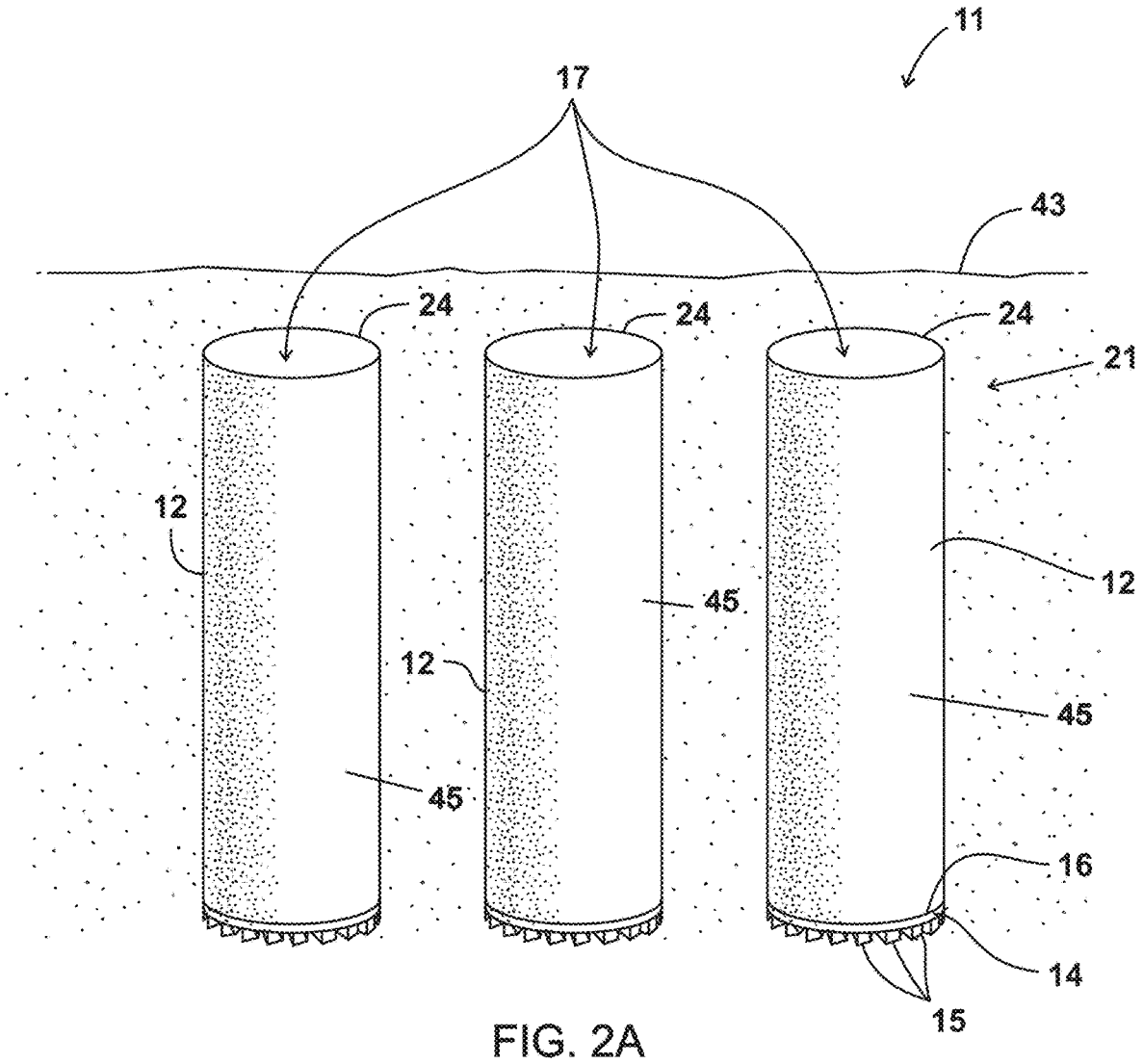
FIGS. 2A and 2B are perspective views of second preferred embodiments of an earth stabilization system of the present invention including hollow members with substantially level upper portions.
Figure 2B:
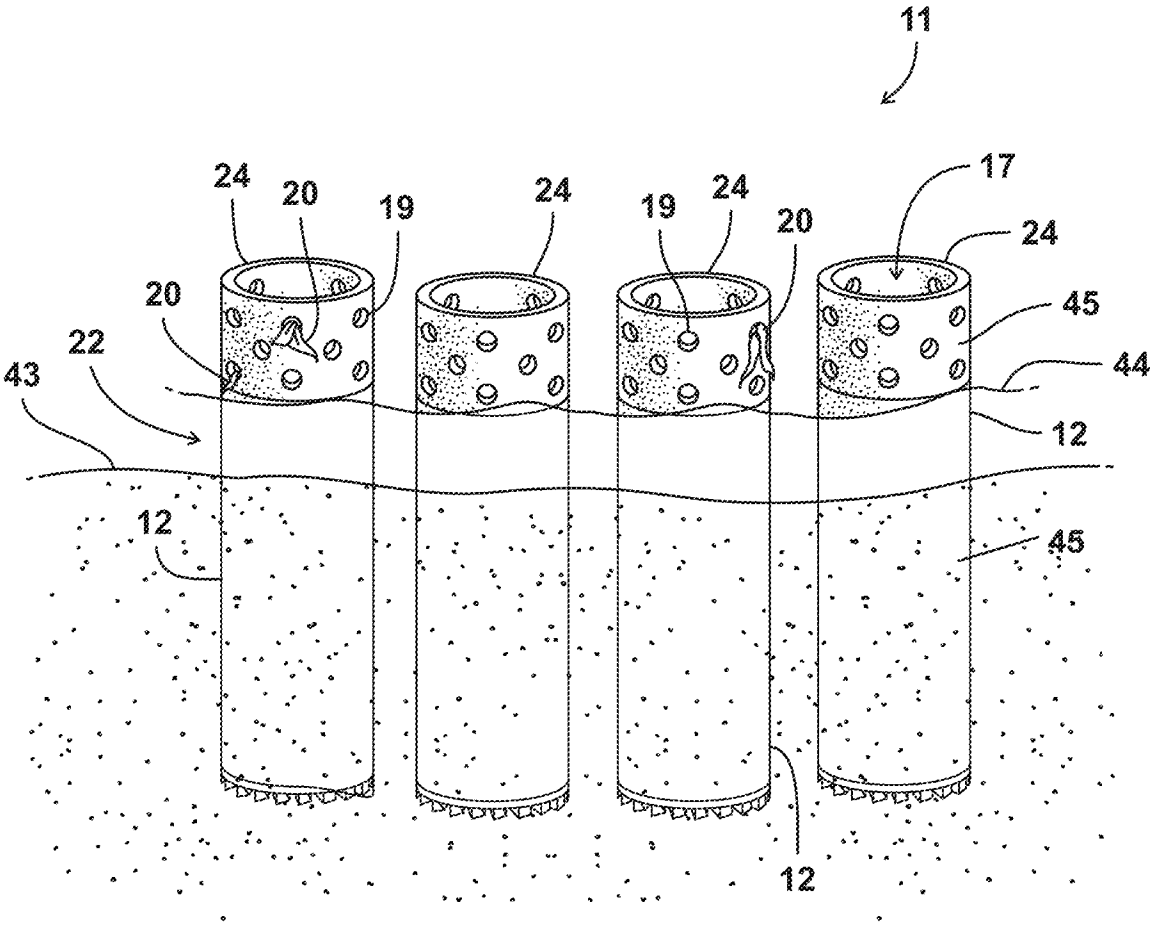

FIGS. 2A-2B illustrate second preferred embodiments of a soil stabilization system designated generally by the numeral 11. In the embodiment as shown in FIG. 2A, hollow members 12 do not include an extension portion 13. The hollow members 12 are positioned in soil mass 21 completely below surface 43. In this embodiment, the hollow members 12 help stabilize soil mass 21 and prevent erosion, and the natural landscape and/or waterbed is preserved.

In the embodiment of FIG. 2B, hollow members 12 also do not include an extension portion 13. In FIG. 2B, the upper portion/top 24 of hollow members 12 along with a portion of wall/sidewall 45 of hollow member 12 extend above surface 43. If desired, wall/sidewall 45 of hollow member 12 can include one or more holes or openings 19, e.g., in portions of wall/sidewall 45 that extend above ground surface 43 and/or above water surface 44, and/or in portions of wall/sidewall 45 that extend below surface 43. Vegetation 20, e.g., natural and/or synthetic vegetation, or other desired natural and/or synthetic materials, can be positioned within a hollow opening or substantially central bore or borehole 17 of hollow member 12 that extends above surface 43, and/or through any opening 19. Rock, gravel, sediment and/or other desired natural and/or synthetic material can also be placed within a central bore or borehole 17. In FIG. 2B, all hollow members 12 have openings 19 in portions of sidewall 45 that extends above surface 44. Alternatively, portions of sidewall at any location above surface 43 can have openings 19. In one or more embodiments, a system can include some hollow members 12 with openings 19 in an upper portion of sidewall 45, while other hollow members 12 do not include any openings 19 in an upper portion of sidewall 45.

As shown in FIGS. 1A-1B and 2A-2B, a plurality of hollow members 12 are preferably provided in a soil stabilization system 10 or 11, and the hollow members 12 can be spaced apart from one another a desired distance, e.g., about 6 to 72 inches apart from one another. Hollow members 12 can be positioned in a single row (e.g., see FIGS. 1B, 2A-2B) or in one or more rows as desired (e.g., see FIG. 1A). Hollow members 12 can be positioned in a substantially linear configuration as shown in FIG. 2A, or in a curved configuration as shown in FIG. 1B. In some embodiments, one or more rows of hollow members 12 can be curved, and one or more rows of hollow members 12 can be substantially straight.

A hollow member 12 is depicted in FIGS. 1A-1B and 2A-2B. Other embodiments of hollow members, piles or jars as described and shown herein, e.g., a hollow member 50, can also be used in a soil stabilization system 10 and/or 11.

Referring now to FIGS. 3A-4D, alternative preferred embodiments of a hollow member 12, which can be used in soil stabilization systems 10, 11 are shown. A hollow member 12 can be a pile or jar. In FIG. 3A, a top view of sloped portion 42 of extension portion 13 is shown, which is coupled to hollow member 12. FIG. 3B is an exploded, sectional view taken along lines 3B-3B of FIG. 1A showing how extension portion 13 can be coupled to hollow member 12 and how hollow member 12 can be coupled to base cutter portion 14.

Figure 4A:
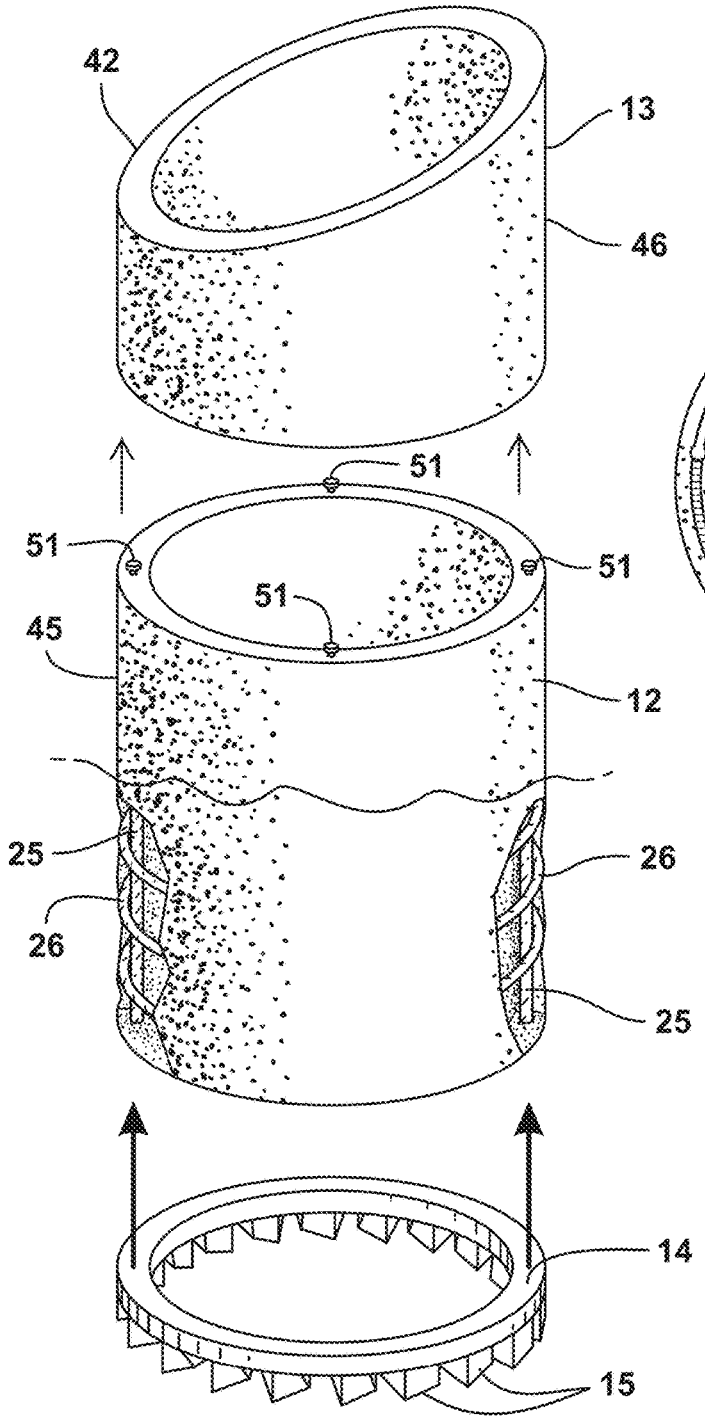
FIG. 4A is a partial cut away, exploded view of an alternate embodiment of the hollow member of the present invention as shown in FIGS. 3A-3B, which can be used in one or more preferred embodiments of the system and method of the present invention.

A hollow member 12 and extension portion 13 can be made of reinforced concrete 47 with one or more spaced apart substantially vertical or longitudinal reinforcing members/bars 25 and one or more spaced apart substantially horizontal or lateral reinforcing members 26, as shown in FIGS. 3B and 4A. Longitudinal 25 and lateral 26 reinforcing members/bars can be steel reinforcing bars or "Rebar" within wall/side wall portion 45 of a hollow member 12 and/or in wall/side wall portion 46 of extension portion 13.

Lateral reinforcing members/bars 26 can extend laterally in a spirally wrapped configuration within sidewall portion 45, e.g., as shown in FIG. 4A, for example. In some embodiments, as shown in FIG. 4C, a wall 45 can include only longitudinal reinforcing bars or members 25. In other embodiments, a wall 45 can include only laterally reinforcing bars or members 26. Concrete 47 can be made from Portland cement concrete material (e.g., cast in a steel or metal or wooden mold), and/or can be made from polymer concrete and polymer-modified concrete materials.

Base cutter portion 14 can be metal, e.g., steel or another desired metal. A base cutter portion 14 is sometimes referred to herein as a base cutter. Base cutter portion 14 can also comprise, or include, diamond tip or carbide tip. Base cutter portion 14 can be made of a combination of concrete materials, composite materials, steel, diamond, carbide, epoxy, carbon fibers, metal fibers or mesh, glass, resin or other desired materials.

Figure 3C:
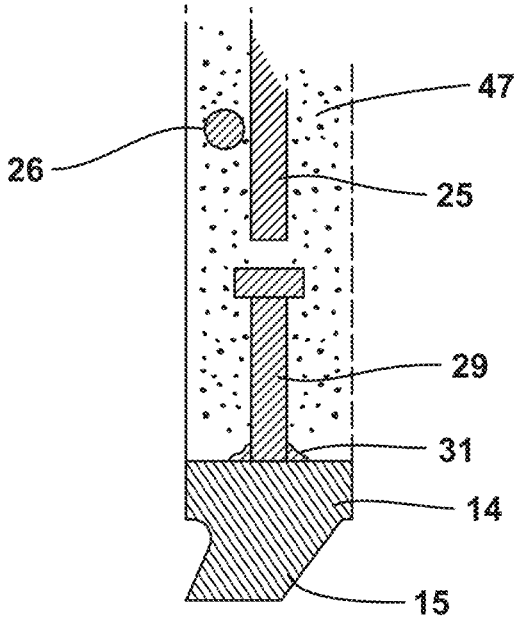
FIG. 3C is a partial cut away, sectional view of a first preferred embodiment of a hollow member of the present invention as shown in FIG. 1A illustrating a base cutter with a stud or bolt embedded in concrete of the hollow member.

In the embodiment of FIGS. 3A-3C, a base cutter portion 14 includes studs or bolts 29, which can be a Nelson stud or Nelson bolt as shown in FIGS. 3B-3C. A stud or bolt 29 can be welded to base cutter portion 14 at a weld 31. If a stud or bolt 29 is a Nelson anchor stud or Nelson anchor bolt, it can be welded to any metal part on the base cutter portion 14 to be poured into concrete. A stud or bolt 29 can also be coupled to a base cutter portion in other suitable ways as are currently known in the art or to be developed in the future. A stud or bolt 29, e.g., a Nelson anchor stud or bolt, can affect coupling or fastening of base cutter portion 14 to concrete 47, and securely hold base cutter portion 14 in concrete 47. A cement mix that can be used to form concrete 47 of a hollow member 12 can be poured over a base cutter portion 14 with a stud or bolt 29 thereon, as shown in FIGS. 3B and 3C, for example, and allowed to set and harden. After setting and hardening, base cutter portion 14 will be coupled to hollow member 12.

Upper portion/top 24 of hollow member 12 preferably includes a pin 28 with top/head 51 and longitudinal portion 64 (see FIGS. 3B, 3D, 3E and 4A) extending upwards from upper portion/top 24 and embedded in hollow member 12, e.g., when a concrete hollow member 12 is cast. Pin 28 is preferably made of high quality and high strength steel. Pin 28 can be a lift, turn, lock, drive, or connecting pin.

Upper portion/top 24 of a hollow member most preferably includes a lift anchor 76, which is sometimes referred to in the art as a DogBone or DogBone Anchor, as shown in FIGS. 23A-23B. Lift anchor 76 can be embedded in and extend upwards from upper portion/top 24 of hollow member 12, e.g., when a concrete hollow member 12 is cast. Lift anchor 76 can include a top/head 77, bottom anchor portion 78 and longitudinal portion 79. Lift anchor 76 can be a DogBone Anchor, sold under part number DB-52 under the trademark MeadowBurke and/or MB, which are commercially available (see MeadowBurke.com). The table in FIG. 23C shows standard anchor sizes and safe working loads in various concrete strengths for DogBone Anchors sold by MeadowBurke.

Figure 3D:
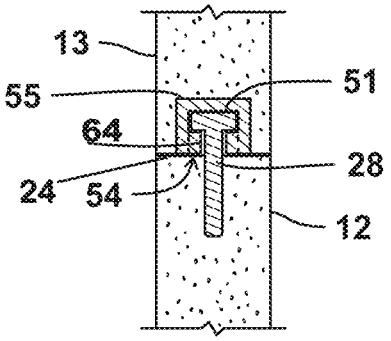
FIGS. 3D and 3E are partial cut away, sectional views of a first preferred embodiment of a hollow member of the present invention as shown in FIG. 1A illustrating a location where an extension portion can be coupled to the hollow member.
Figure 3E:
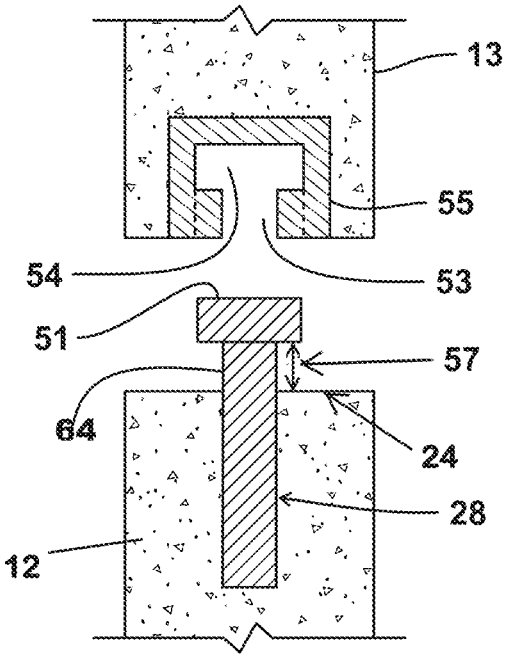
Figure 3F:
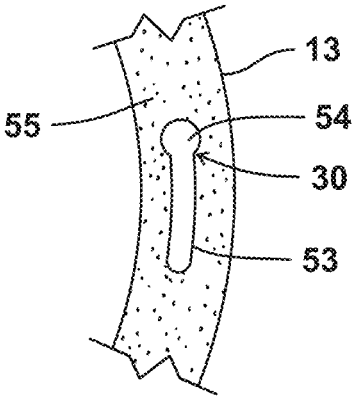
FIG. 3F is a cut away, close up view of a preferred embodiment of a locking ring that can be included on an extension portion.
Figure 4B:
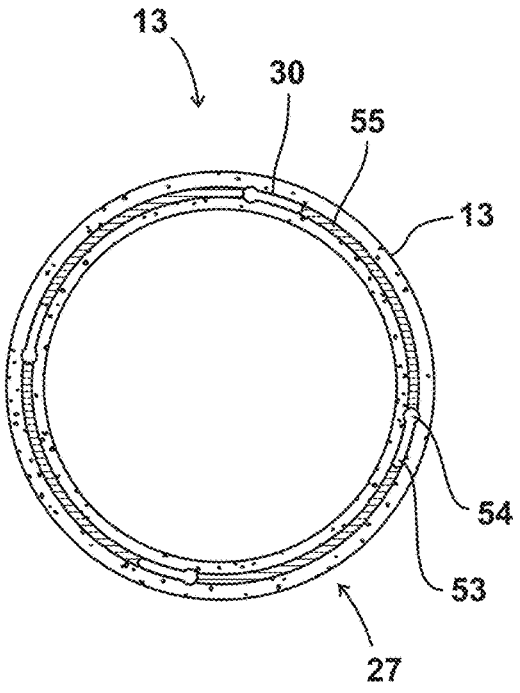
FIG. 4B is a bottom view of the top extension portion as shown in FIG. 4A.
Figure 4C:
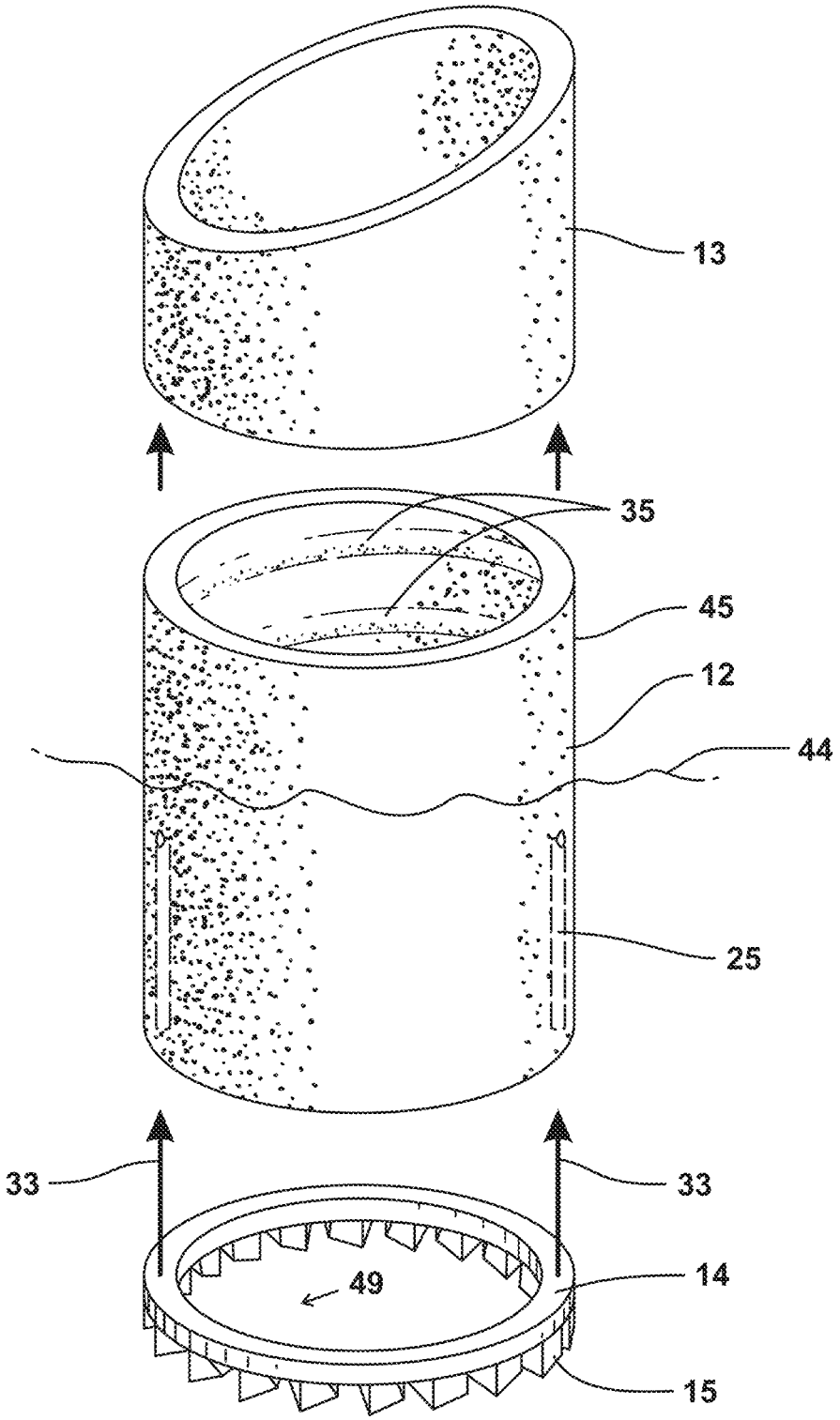
FIG. 4C is an exploded view of another alternative embodiment of the hollow member as shown in FIGS. 3A-3B, which can be used in one or more preferred embodiments of the system and method of the present invention.

An extension portion 13 can include a ring 55, e.g., a metal ring, including slots/locks 35 (see FIG. 4B). Ring 55 can be embedded in a lower portion of extension portion 13, e.g., when a concrete extension portion 13 is cast. Preferably a ring 55 is made of high strength steel. FIG. 4B provides a bottom view of extension portion 13 and illustrates an embodiment of a slot/lock 30 on a locking ring 55. FIG. 3F is a close up view of a slot/lock 30 on ring 55.

A space 57 preferably is provided between top/head 51 of a pin 28 and upper portion/top 24, or between a top/head 77 of a lift anchor 76 and upper portion/top 24, for enabling top/head 51, 77 of pin 28 or lift anchor 76 to be inserted into larger portion 54 of slot/lock 30 of extension portion 13 (see FIGS. 3A-3F, 4B) and rotated into narrower portion 53 of slot/lock 30 to lock pin 28 or lift anchor 76 in slot/lock 30 affect coupling of extension portion 13 to hollow member 12. FIG. 3D is a close up view illustrating top/head 51 within slot/lock 30. FIG. 3E is a close up view illustrating how top/head 51 of pin 28 can be inserted into larger opening 54 of slot/lock 30. A lift anchor 76 top/head 77 can be locked within a slot/lock 30 in a same or similar manner as shown in FIGS. 3D, 3E.

A pin 28 or lift anchor 76 can also be coupled to or locked within a turning tool or drive unit 34 or 37, as described further below with regards to FIGS. 5A-5B and 7-12. A hollow member 50 can also have one or more pins 28 (and/or lift anchors 76) and a notch design for coupling to a drive unit 65 that includes a block design (see, e.g., FIGS. 19-21B), as described further below. Upper portion/top 24 of hollow member 12 can be formed and adapted for use with a turning tool or drive unit 65, as discussed further below. A desired amount, e.g., 1, 2, 3, 4, 5, 6, or more, of locking or turning pins 28 with a head or top 51, and/or lift anchors 76 with a head/top 77, can be included at upper portion/top 24 of wall 45 of hollow member 12, or in upper portion/top 71 of hollow member 50. Preferably, at least 4 pins 28 or lift anchors 76 are included. A hollow member 12 or 50 can also be coupled to extension portion 13 or 67 and/or to a turning tool or drive unit 34, 37, 65 via other suitable means as currently known in the art or to be developed in the future. In some embodiments one or more locking pins 28 and one or more lift anchors 76 can be embedded in a top portion 24, 71 or a hollow member 12, 50.

In one or more embodiments, notches 35, as shown in FIG. 4C, can be included on an interior surface of wall 45 of hollow member 12 to help facilitate movement of displaced soil upwards in borehole 17. Notches 35 can be included spirally along an interior of wall 45. In other embodiments, material, e.g., metal or plastic can be included on an interior surface of wall 45, e.g., in a spiral configuration, to facilitate movement of displaced soil of soil mass 21 in an upwards direction. Notches 35 can also be included on an interior of wall 63 of hollow member 50 in a similar or the same manner as discussed above.

Figure 4D:
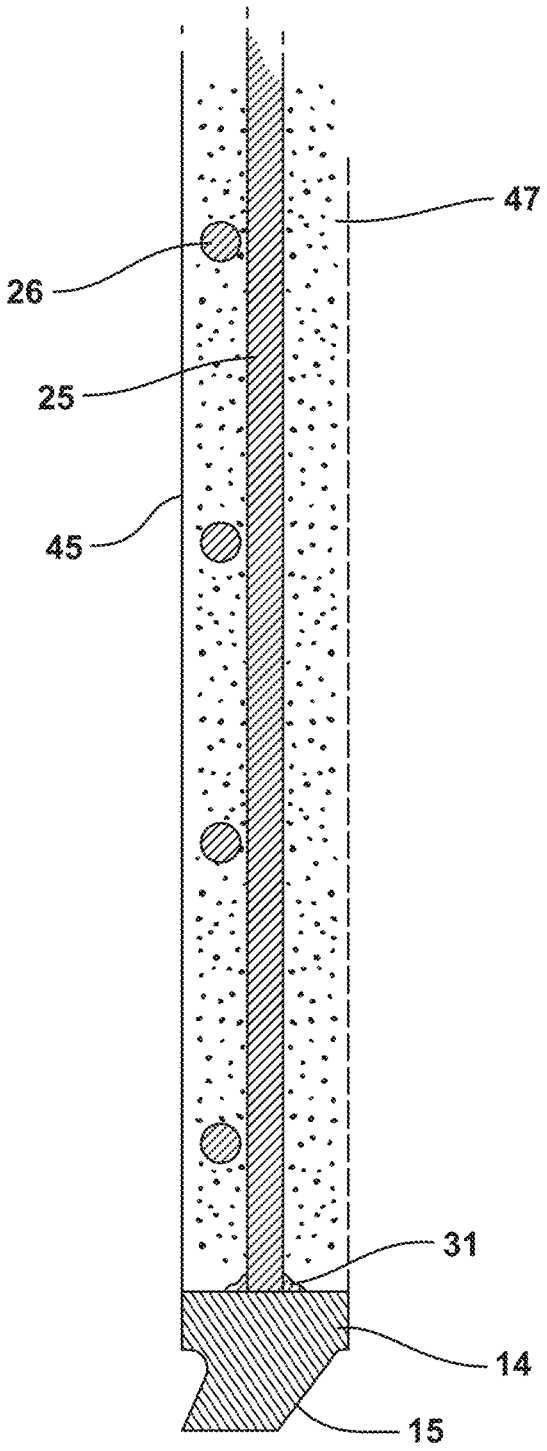
FIG. 4D is a partial sectional view illustrating a preferred embodiment of a connection between reinforcing material in a wall of the hollow member as shown in FIG. 4A and a base cutter.

In FIGS. 4A-4D, an alternate embodiment of a base cutter 14 connection is shown. Base cutter portion 14 in FIGS. 4A, 4C does not include a stud or anchor 29. Base cutter portion 14 is welded to longitudinal reinforcing member 25 in wall 45 of hollow member 12 at weld 31, e.g., as shown in FIG. 4D. Base cutter portion 14 can alternatively be welded to a lateral reinforcing member 26. Base cutter portion 14 can also be welded to both a longitudinal reinforcing member 25 and a lateral reinforcing member 26.

In FIG. 4C, wall 45 includes only longitudinal reinforcing bars/members 25. In other embodiments, only lateral reinforcing bars/members 26 can be used if desired.

In FIGS. 13A-14B and 17-18, another preferred embodiment of a hollow member that can be used in soil stabilization systems 10, 11 is shown and designated by the numeral 50. Hollow member 50 can be a pile or jar. Hollow member 50 differs from hollow member 12 in that hollow member 50 includes a base cutter portion/base cutter 48 formed as an integral part of a single piece construction of hollow member 50, wherein base cutter 48 is integral with, or formed as part of hollow member 50 sidewall 63. A hollow member 50 is a one piece concrete pour including teeth 59 of base cutter portion/base cutter 48.

A sidewall 63 of hollow member 50 can be made of the same or similar material as a sidewall 45 of a hollow member 12 and include longitudinal 25 and/or lateral 26 reinforcing members or bars. A hollow member 50 can be included in one or more embodiments of earthen stabilization systems as shown and described herein, including as shown in FIGS. 1A-2B and 15.

In one or more embodiments of a hollow member 50, cutters/teeth 59 on base cutter portion 48 can be made of the same material, e.g., the same concrete mix, as the hollow member 50 wall portion/sidewall 63. Thus, a bottom surface of cutters or teeth 59 on a cutter portion 48 can be of the same material as the hollow member 50 wall portion 63. Alternatively, in one or more embodiments of a hollow member 50, cutters or teeth 59 can be metal teeth or include other metal protrusions. Cutters/teeth 59 can be steel. Cutters/teeth 59 can be formed from the same material as hollow member 50 wall portion 63 and be coated with a wear resistant or cutting material, e.g., a wear resistant or cutting material including metal or metal fragments, fibers or tips; steel fragments, fibers or tips; diamond tips or particles; carbide tips or particles, epoxy, resin, glass or other desired material. Cutters/teeth 59 could also be formed from the same material as hollow member 50 wall portion/side wall 63 and further include a wear resistant or cutting material in the material mix, e.g., metal or metal fragments, fibers or tips; steel fragments, fibers or tips; diamond tips or particles; carbide tips or particles, epoxy, resin, glass or other desired wear resistant or cutting material in the material mix.

In one or more embodiments, cutters/teeth 59 can be placed in the bottom of a base cutter 48 form, which can be at the bottom of hollow member 50 form. Concrete including steel, fibers, and/or polymers or other desired materials can be poured into the base cutter 48 form portion. Concrete can then be poured into a hollow member 50 form portion, which can set with the base cutter 48 pour mix, e.g., a concrete pour mix, at a bottom of the hollow member 50 form portion. The hollow member 50 form portion can also include longitudinal 25 and/or lateral 26 reinforcing members or bars (e.g., "Rebar") or other desired reinforcing material for a concrete pour to be poured over, e.g., in the mold or form.

In one or more embodiments, a hollow member 50 can include a pin 28 or lift anchor 76 in an upper portion/top 71 of hollow member 50 for coupling to a drive unit 34 or 37, and/or for coupling to an extension portion 13, 67 in a similar or same manner as described herein with regard to FIGS. 3B, 4A-4B, 5A-5B and 7-12 (and see FIGS. 23A-23B showing a lift anchor 76 that can be used in embodiments of FIGS. 3B, 4A-4B, 5A-5B and 7-12 instead of a pin 28). A hollow member 50 can also have a pin 28 (or lift anchor 76) and a notch design for coupling to a drive unit 65 that includes a block design (see, e.g., FIGS. 19-21B), as described further below.

Figure 19:
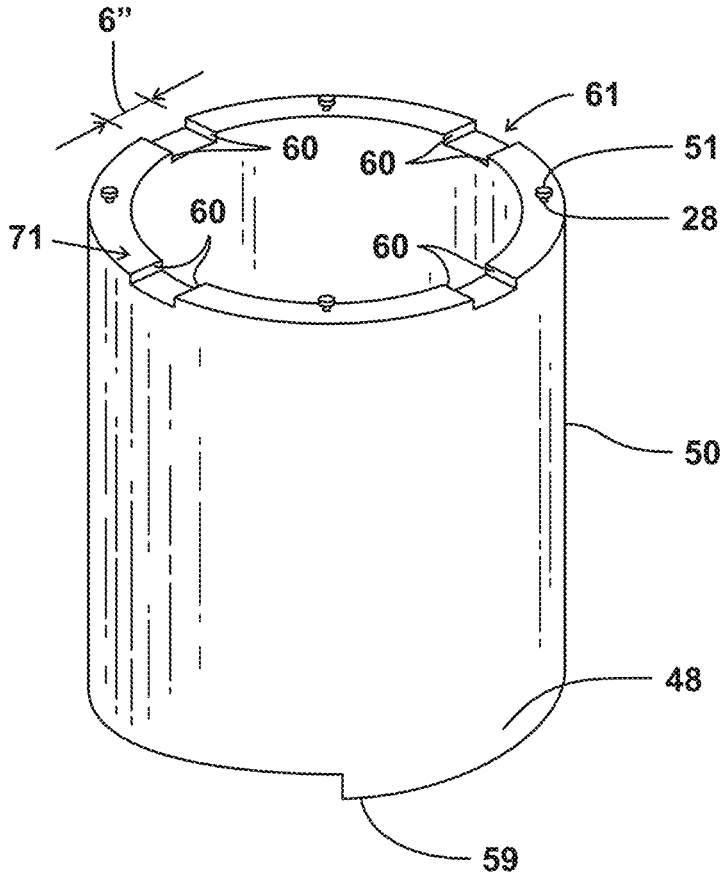
FIG. 19 is a perspective view of an alternate embodiment of a hollow member of the present invention as shown in FIGS. 13A-13B including a notched design, which can be used in one or more preferred embodiments of the system and method of the present invention.
Figure 20:
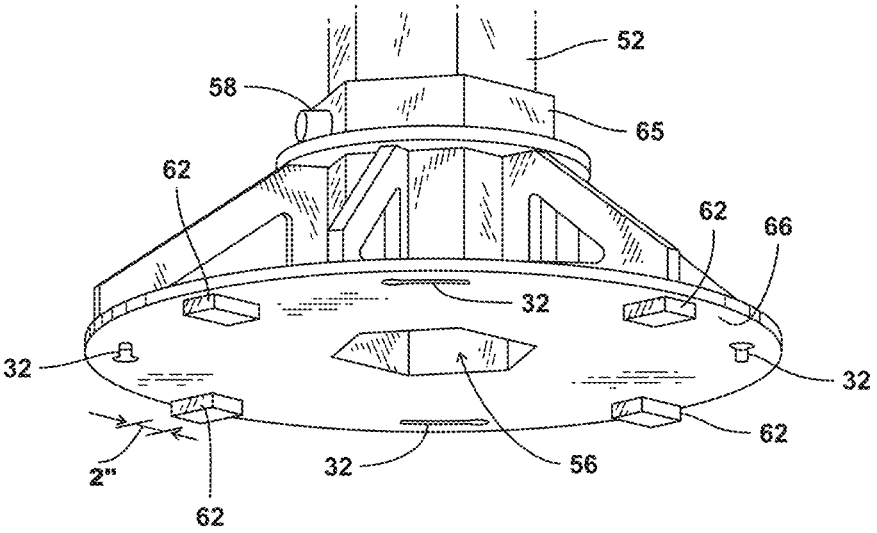
FIG. 20 is a perspective view of a third preferred embodiment of a turning tool or drive unit that can be used with a hollow member as shown in FIG. 19.

If a hollow member 12 or 50 has a notch design included in upper portion/top 24 or 71 of the hollow member 12 or 50 with one or more notches 61, an extension portion 13 or 67 can have a block design on a bottom surface of the extension portion 13, 67 with one or more blocks 62 for mating with the notches 61 on upper portion/top 24 or 71 of the hollow member 12 or 50 (see, e.g., blocks 62 on turning tool/drive unit 65 in FIG. 20; see also FIGS. 19-21B). In this embodiment, an extension portion 13 or 67 with a block design can be coupled to a hollow member 12 or 50 with notches 61 in a similar or same manner as described and shown with regard to blocks 62 on turning tool/drive unit 65.).

Teeth/cutters 15, 59 preferably are arranged on a base cutter portion 14, 48 in a substantially clockwise orientation for clockwise rotation while driving the hollow member 12, 50 into soil mass 21. Alternatively, the teeth/cutters 15, 59 can be positioned on base cutter portion 14, 48 in a substantially counterclockwise orientation if desired for counterclockwise rotation of a hollow member 12, 50 into soil mass 21, e.g., the ground or a waterbed.

Figure 22B:
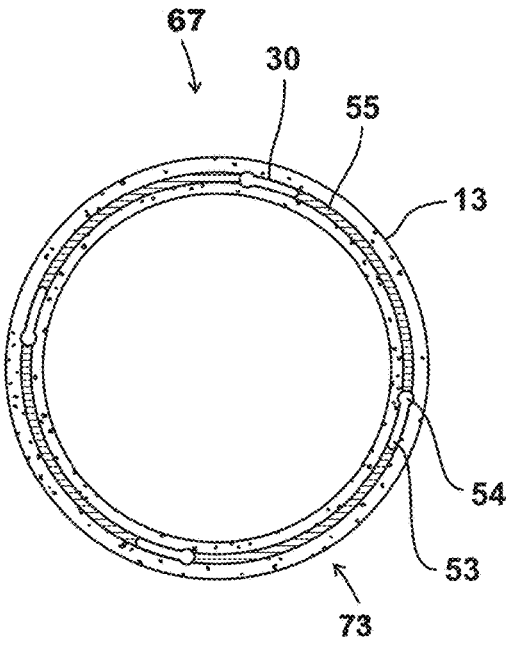
FIG. 22B is a bottom view of the extension portion as shown in FIG. 22A.

Turning now to a further discussion of an extension portion 13, 67, reference is made to FIGS. 4A-4B and 22A-22B. Preferably, a bottom portion 27, 73 of top or extension portion 13, 67 can include a metal ring 55 as shown in FIGS. 4B, 22B that includes one or more slot or lock portions 30 that have a wider portion 54 and a narrower portion 53. The top or head 51 of pin 28 (or top or head 77 of lift anchor 76) can be positioned through the wider portion 54 of slot or lock 30. The top/extension portion 13, 67 can then be rotated so that the longitudinal portion 63 of pin 28 of a hollow member 12, 50 (or longitudinal portion 79 of lift anchor 76) moves into narrow portion 53 of slot or lock 30 and lock pin 28 or lift anchor 76 in slot or lock 30. Other slot or lock configurations or mechanisms can be included on bottom 27, 73 of top/extension portion 13, 67 that are known and/or commonly used in the precast industry. Slot or lock 30 preferably is adapted to form a releasable connection with a pin 28 or lift anchor 76 that is included in hollow member 12 or 50 and has head/top portion 51, 77 extending a desired distance above upper portion/top 24, 71 of hollow member 12 or 50.

Alternatively, a bottom or bottom portion 27, 73 of extension portion 13 or 67 can include slot or lock portions 30 formed into bottom portion 27, 73, e.g., as part of the concrete 47 wall 46, with the slot or lock 30 preferably adapted to form a releasable connection with a pin 28 or lift anchor 76 that is included in hollow member 12 or 50 and has head/top portion 51, 77 extending a desired distance above upper portion/top 24, 71 of hollow member 12 or 50. In this embodiment, slot or lock 30 can be of similar configuration to what is shown in FIGS. 4B and 22B on bottom 27, 73 and/or to what is shown on turning tools or drive units 34, 37, 65 in FIGS. 7-12, and 20, with a narrow portion 53 and wider portion 54, but without a metal ring 55 containing the slots 30.

As shown in FIG. 22A, an extension portion of a hollow member 12, 50 can be a top or extension portion 67 that has a relatively flat or level upper portion/top 68 instead of a sloped upper portion 42. The relatively flat or level upper portion/top 68 of extension portion 67 can be the same or similar to upper portion/top 24 of a hollow member 12, or the upper portion/top 71 of hollow member 50. As discussed, an extension portion 67 can include a slot or lock 30 mechanism on a bottom 73 for coupling to a pin 28 or lift anchor 76 on a hollow member 12, 50. In some embodiments, an extension portion 67 can include a pin 28 or lift anchor 76 in an upper portion/top 68 that protrudes a desired distance above upper portion/top 68, for enabling attachment to another extension portion 67 and/or to an extension portion 13. In this manner, a first extension portion 67 can be coupled to a hollow member 12 or 50, and a second extension portion 67 can be coupled to the first extension portion 67. Additional extension portions 67 can be provided until a desired height is reached. A drive unit or turning tool 34, 37 or 65 can be coupled to an uppermost extension portion 67 to drive the entire unit that is coupled together into the ground. An extension portion 13 with a slanted surface/slope 42 can also be coupled to an upper portion/top 68 of an extension portion 67, e.g., as a final extension portion 13 if desired, after driving the entire coupled unit with a hollow member 12 or 50 and one or more extension portions 67 into soil mass 21.

Including a metal ring 55 with slot or lock portions 30 on the bottom portion 27, 73 of an extension portion 13, 67 can be desirable to achieve a tighter and/or stronger connection. This may be desirable for example when adding on additional extensions 67 and/or extensions 13 to increase length in deeper water.

Figure 5B:
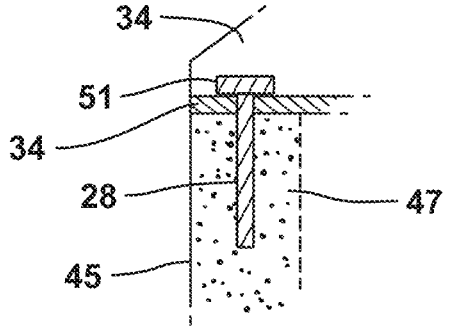
FIG. 5B is a close up cutaway view of the hollow member in FIG. 5A.
Figure 5A:
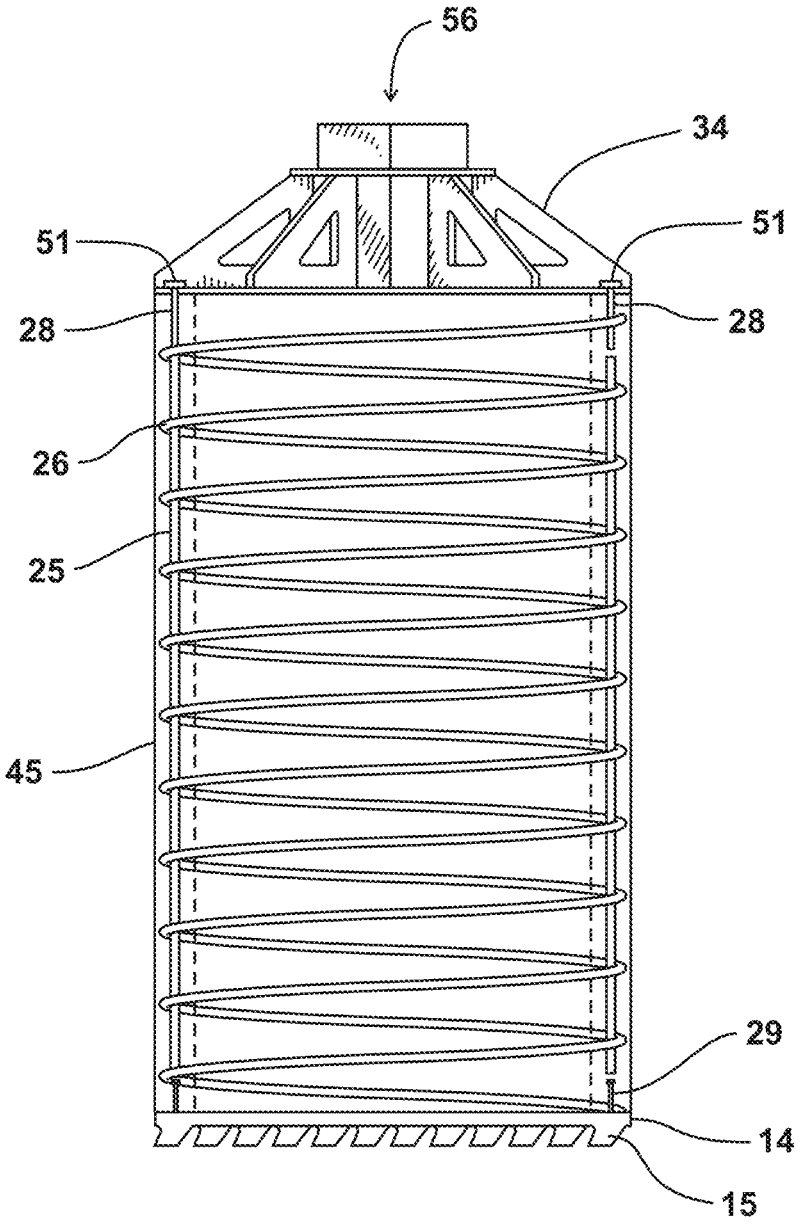
FIG. 5A is a cutaway view of a hollow member of the present invention of the embodiment of FIG. 3B coupled to a turning tool instead of an extension portion, which can be used in one or more preferred embodiments of the system and method of the present invention.
Figure 6:
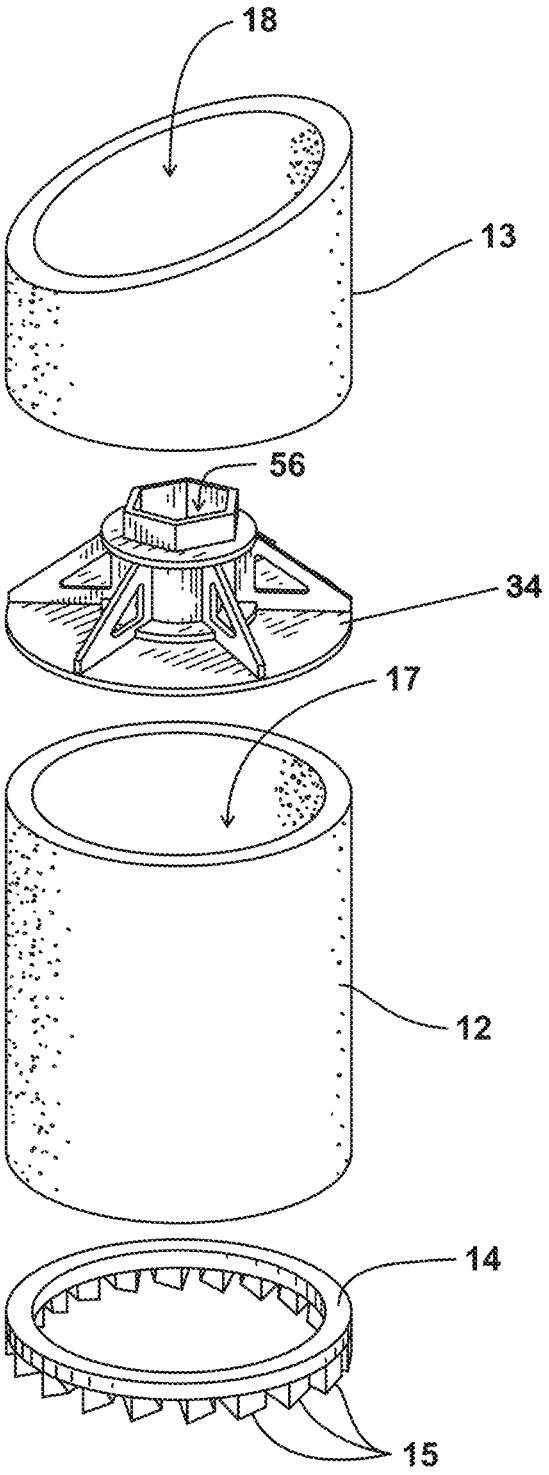
FIG. 6 is an exploded view illustrating the hollow member of the present invention of FIG. 4C that can be coupled to a turning tool for rotating into the ground, and also which can be coupled to a top extension portion in one or more preferred embodiments of the system and method of the present invention.
Figure 7:
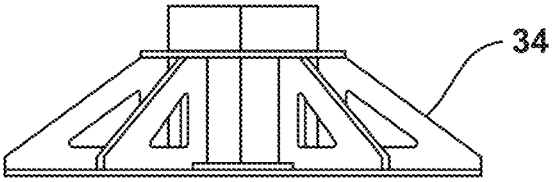
FIG. 7 is a side perspective view of a first preferred embodiment of a turning tool or drive unit that can be used in one or more preferred embodiments of the system and method of the present invention.
Figure 8:
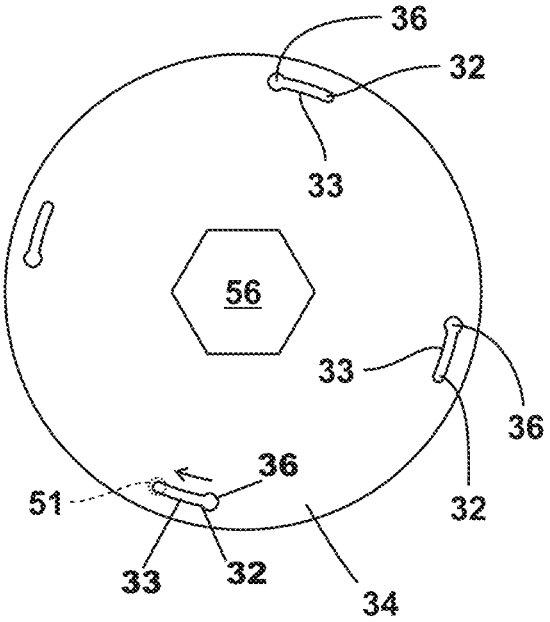
FIG. 8 is a bottom view of the turning tool or drive unit as shown in FIG. 7.
Figure 9:
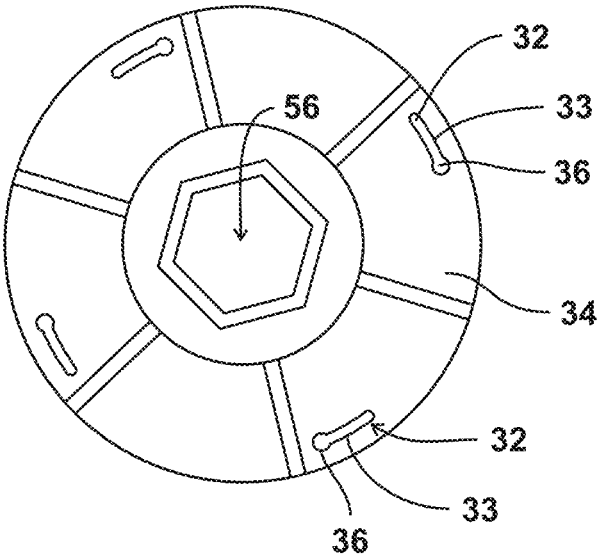
FIG. 9 is a top view of the turning tool or drive unit as shown in FIG. 7.

Turning now to a discussion of turning tools or drive units that can be used in one or more preferred embodiments of the present invention, reference is made to FIGS. 5A-12 and 19-21B. To couple a turning tool or drive unit 34, as shown in FIGS. 7-9, to hollow member 12 or 50, head 51 of pin 28 (or head 77 of lift anchor 76) can be inserted through the wider opening/larger portion 36 of a slot/lock 32, and drive unit 34 can be rotated to lock pin 28 or lift anchor 76 in narrower portion of the slot/lock 32. Referring to FIGS. 5A-5B and 8, head 51 of a pin 28 can be inserted into larger portion 36 of slot 32. Pin 28 longitudinal portion 64 can move in the direction of arrow 23 in slot 32 until head 51 is at or about an end of slot 32 to lock pin 28 in place. The location of top/head 51 when a pin 28 is locked in a slot 32 is shown in FIG. 8. Top/head 77 of lift anchor 76 can be locked in a slot 32 in a same or similar manner as shown in and described with regards to FIGS. 5A-5B and 8.

Figure 10:
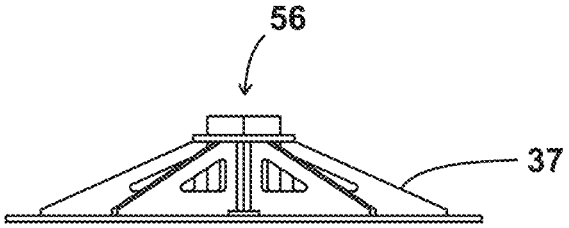
FIG. 10 is a side perspective view of a second preferred embodiment of a turning tool or drive unit that can be used in one or more preferred embodiments of the system and method of the present invention.
Figure 11:
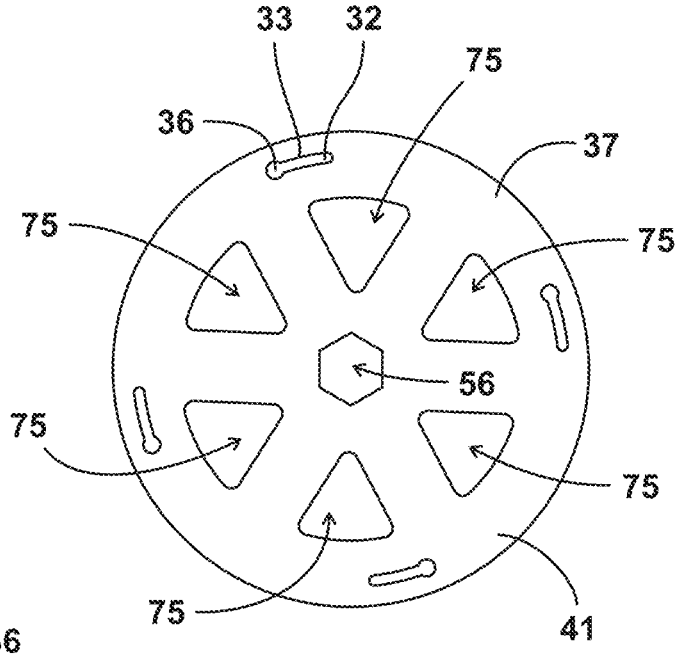
FIG. 11 is a bottom view of the turning tool or drive unit as shown in FIG. 10.
Figure 12:
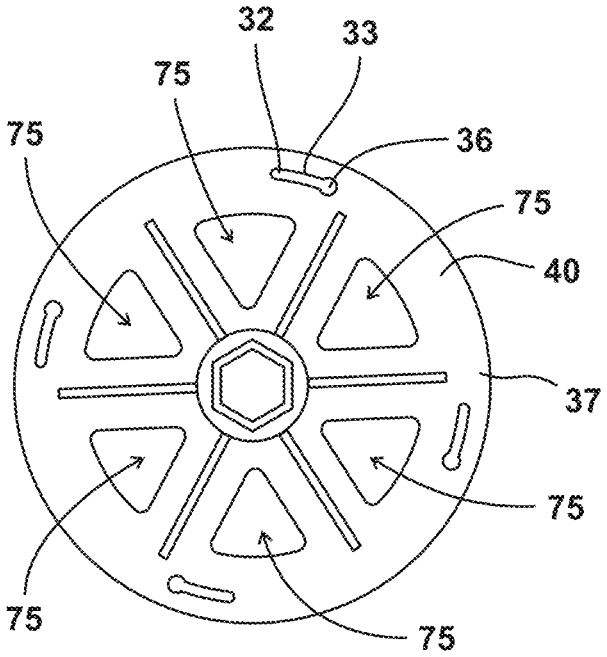
FIG. 12 is a top view of the turning tool or drive unit as shown in FIG. 10.
Figure 13A:
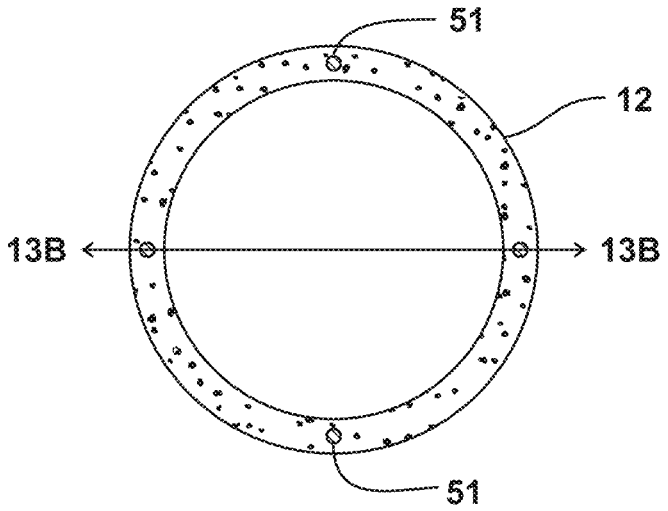
FIG. 13A is a top view of a second preferred embodiment of a hollow member of the present invention including a base cutter as an integral part of a single unit, which can be used in one or more preferred embodiments of the system and method of the present invention.
Figure 13B:
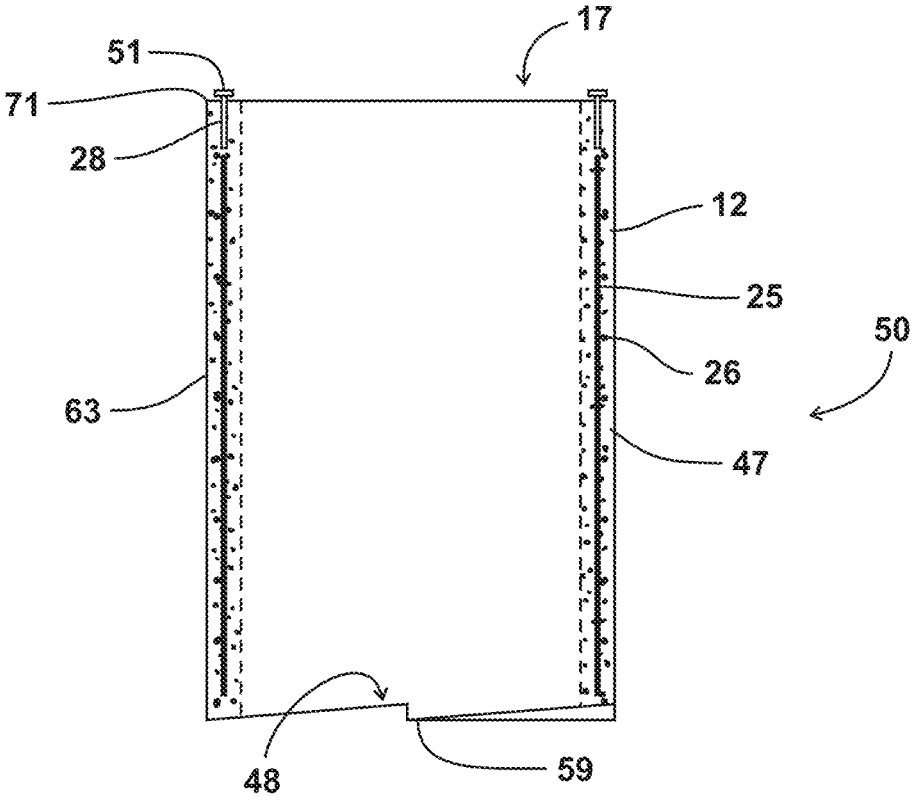
FIG. 13B is a side cutaway view of the hollow member as shown in FIG. 13A.
Figure 14A:
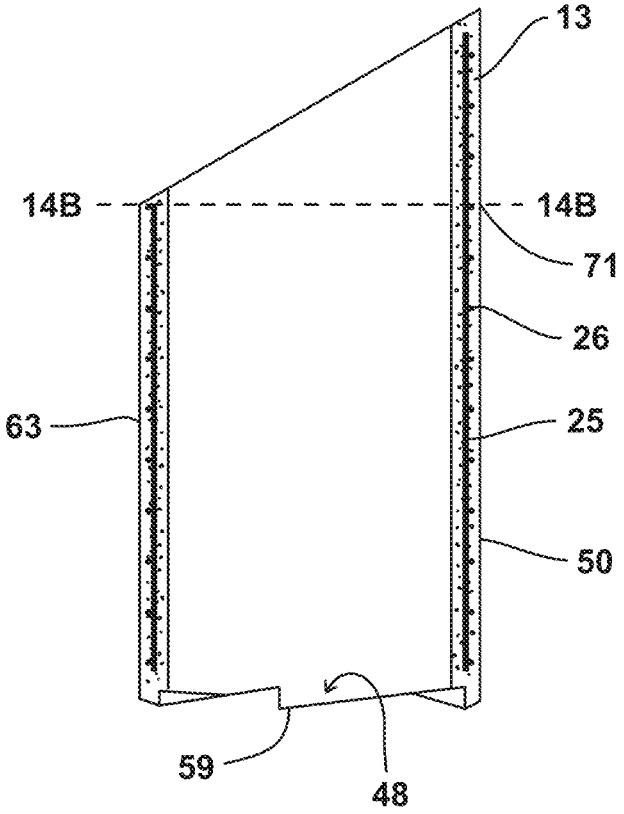
FIG. 14A is a side cutaway view illustrating a hollow member of the present invention as shown in FIG. 13B, and including a top extension portion.
Figure 14B:
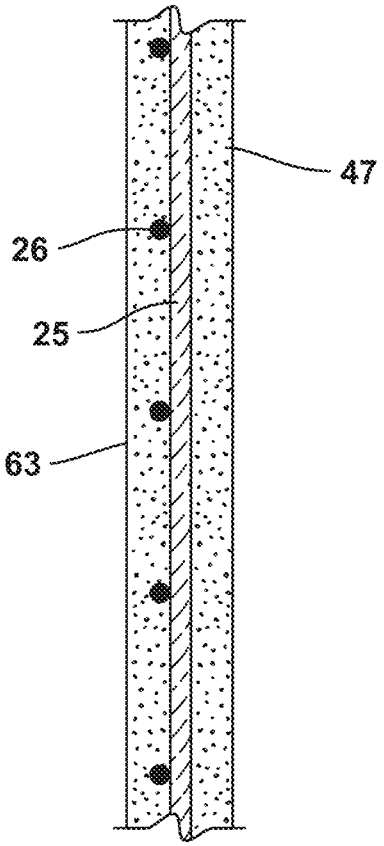
FIG. 14B is a close up, partial cut away view illustrating reinforcing material embedded in the wall of the hollow member as shown in FIG. 14A.
Figure 21A:
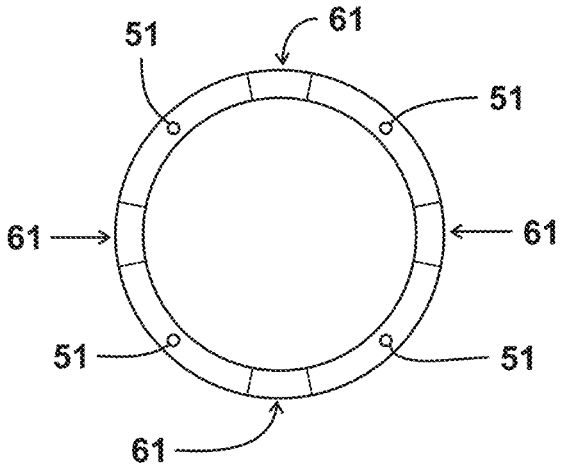
FIG. 21A is a top view of a hollow member as shown in FIG. 19.
Figure 21B:
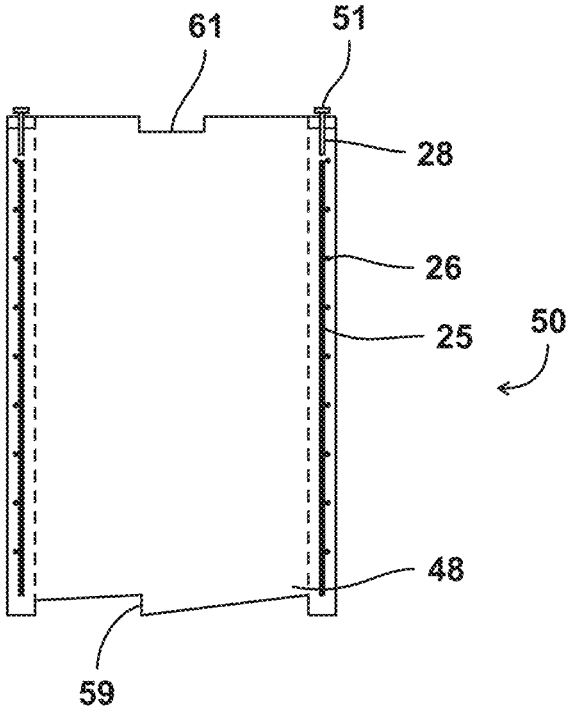
FIG. 21B is a sectional view of a hollow member as shown in FIG. 19.

An alternate embodiment of a turning tool or drive unit 37, as shown in FIGS. 10-12, can also be coupled to a hollow member 12 or 50 that has a pin 28 or lift anchor 76 in the same or similar manner. Turning tool or drive unit 37 is similar to turning tool or drive unit 34 but includes openings 75. FIG. 11 shows bottom 41 of drive unit 37, and FIG. 12 shows top 40 of drive unit 37. A drive unit 65, as shown in FIG. 20 can also be coupled to a hollow member 12 or 50 if hollow members 12 or 50 include a notch design, e.g., as shown in FIGS. 19, 21B. A notch design can be desirable, for example, in deeper applications to provide a stronger locking connection.

Drive units 34, 37, 65 can be coupled to a crane 52 or other suitable machinery at opening or central bore 56 with a coupler 58, for example, as shown in FIG. 20. Lock or turning pins 28 (or lift anchors 76) can be provided as part of a hollow member 12 or 50 to help couple hollow member 12 or 50 to a drive unit 34, 37, 65 at slots or locks 32 of drive unit 34, 37, 65.

In the embodiment of drive unit/turning tool 65 as shown FIG. 20, an alternative or secondary notch and block type system can be provided to go along with the turn or lock drive pins 28 or lift anchors 76 on a hollow member 12 or 50, or extension portion 67, for example, that includes one or more pins 28 or lift anchors 76 embedded therein. As shown in FIGS. 19, and 21B, one or more notches 61 can be provided in a hollow member 50 upper portion/top 71 for mating with one or more blocks 62 on a bottom surface 66 of a drive unit or turning tool 65. Notches 61 can have a width or longitudinal length that is larger than blocks 62. This enables blocks 62 to slide within notches 21 while a locking pin 28 or lift anchor 76 is sliding to lock in slot 32, which can be the same or similar to a slot 32 as shown and described with regard to drive units 34 and 37. Preferably block 62 is in contact with a wall of notch 61 after locking pin 28 or lift anchor 76 is locked in slot 32. Notches 61 and blocks 62 can be sized based on the distance that locking pin 28 or lift anchor 76 will travel within slot/lock 32 so that block 62 makes contact with a wall 60 of notch 61 after locking pin 28 in slot 32.

A block 62 can preferably have about a 2 inch longitudinal width and a notch 61 can preferably have a longitudinal width of about 6 inches. The sizes and dimensions of the blocks and notches can vary as desired, e.g., based on the cylinder structure size and/or based on a locking slot 32 dimensions.

Although not shown, a similar or the same drive unit 65 can be used with a hollow member 12 that can include notches 61 as part of an upper portion/top 24 surface of the hollow member 12 for mating with blocks 62 of the drive unit or turning tool 65. A crane 52, or other suitable machinery, can be coupled to drive unit 65 in central bore 56 of drive unit 65 with a coupler 58, which can be a locking nut, for example. If a hollow member 12 or 50 has a notch design on an upper portion/top 24, 71 of the hollow member 12, 50, a top or extension portion 13 can have a block design on a bottom surface thereof for mating with the notches 61 on the top portion of the hollow member 12 or 50.

Figure 16:
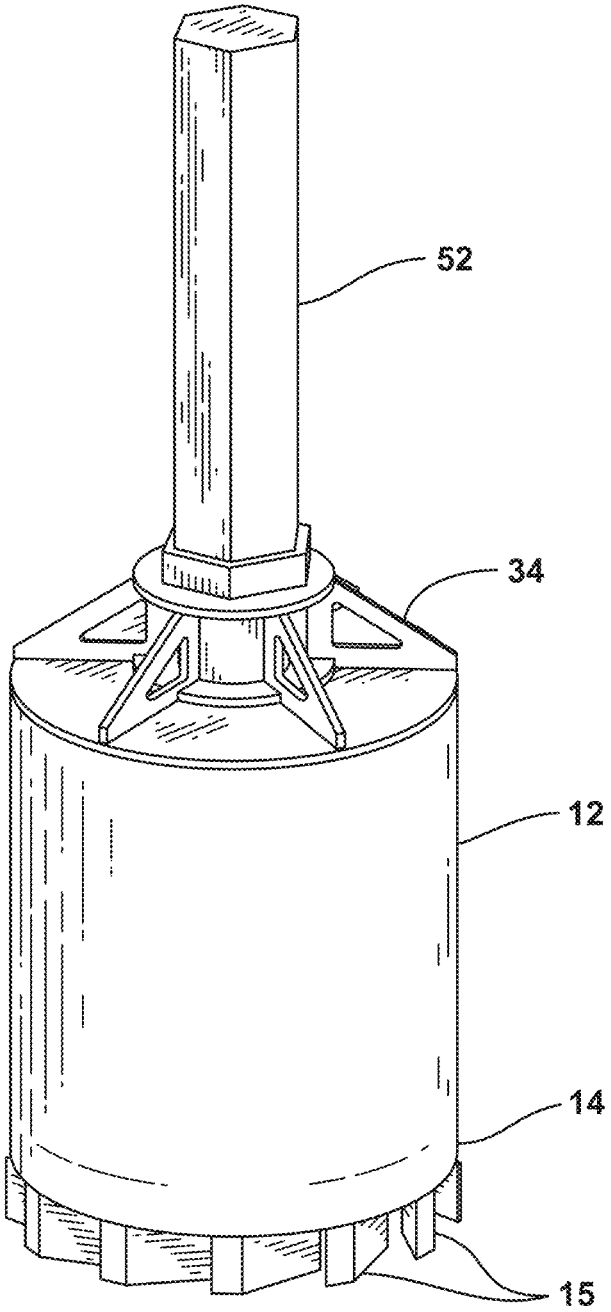
FIG. 16 is a perspective view of a hollow member of the present invention, coupled to a turning tool or drive unit, which is coupled to a crane, and which can be used in one or more preferred embodiments of the method and system of the present invention.
Figure 17:
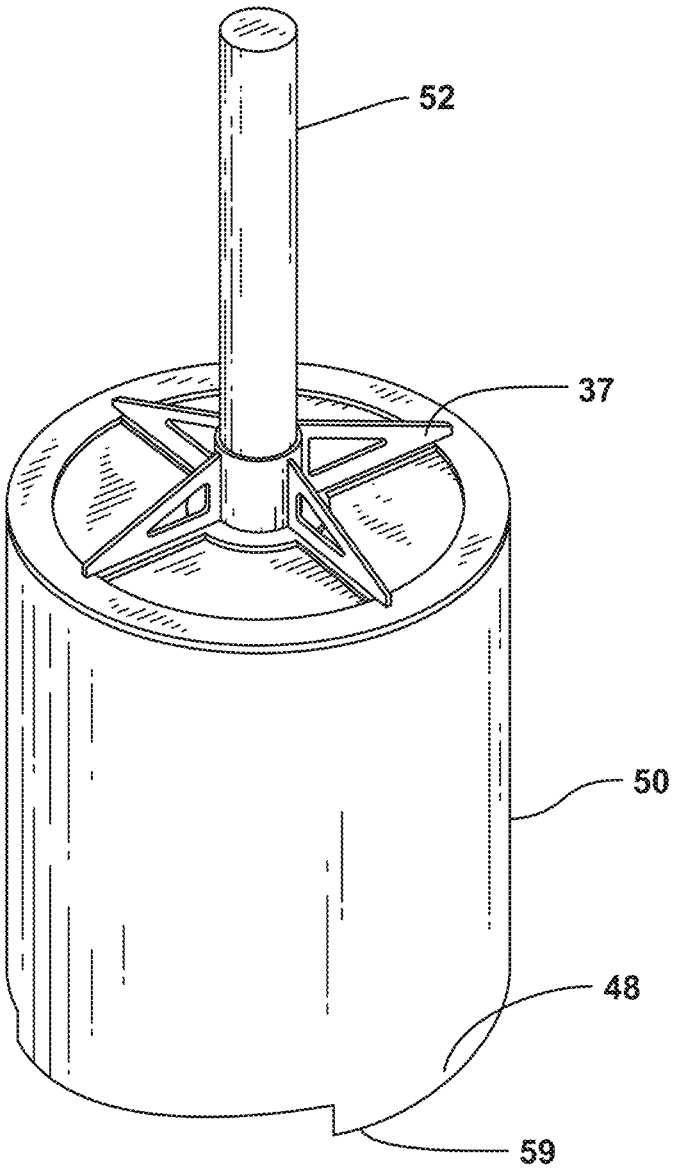
FIG. 17 is a perspective view of a hollow member of the present invention as shown in FIGS. 13A-B that is coupled to a turning tool or drive unit that is coupled to a crane, and which can be used in one or more preferred embodiments of the method and system of the present invention.
Figure 18:
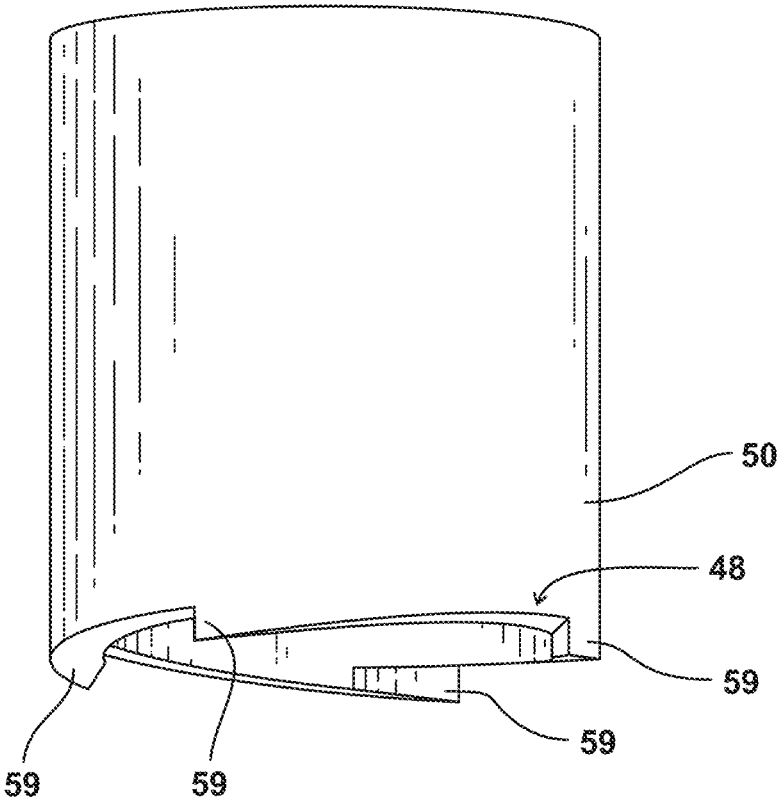
FIG. 18 is another perspective view of a hollow member of FIGS. 13A-13B, which can be used in one or more preferred embodiments of the method and system of the present invention.

In one or more embodiments of the method of the present invention, a hollow member 12, 50 can be driven, screwed, rotated or turned into soil mass 21. A crane 52 or other suitable machinery (shown in partial view in FIGS. 16-17) can be coupled to a drive unit 34, 37 or 65, that is coupled to a hollow member 12 or 50, and which can cause hollow member 12 or 50 to rotate. A drive unit 34, 37 or 65 can also be coupled to an extension portion 67 that is coupled to a hollow member 12 or 50. The weight of the hollow member 12, 50 and the base cutter 14, 48 can facilitate driving, screwing, rotating, or turning of hollow member 12, 50 into soil mass 21. As hollow member 12, 50 is being driven, screwed, rotated, or turned into soil mass 21, soil mass 21 can be displaced and travel through opening or bore 49 in base cutter 14, through opening or bore 17 in hollow member 12, 50 and through opening or central bore 18, in extension portion 13, 67 if included.

In one or more embodiments of the system and method, one or more hollow members 12, 50 can be driven, screwed or turned into soil mass 21 so that hollow member 12, 50 is completely below soil mass 21 surface 43 as shown in FIG. 2A. In one or more embodiments, one or more hollow members 12, 50 can be positioned in soil mass 21 so that a portion of wall 45, 63 of a hollow member 12, 50 is above surface 43 of soil mass 21 as shown in FIG. 2B.

In one or more embodiments of the system and method, one or more hollow members 12, 50 can be driven, screwed or turned into soil mass 21 so that hollow member 12, 50 is completely below soil mass 21 surface 43 as shown in FIG. 2A, and one or more hollow members 12, 50 can be positioned in soil mass 21 so that a portion of wall 45, 63 of a hollow member 12, 50 is above surface 43 of soil mass 21 as shown in FIG. 2B.

In another embodiment of the system and method, one or more hollow members 12, 50 can be driven, screwed or turned completely within soil mass 21 as shown in FIG. 2A, one or more hollow members 12, 50 can be driven, screwed or turned in soil mass 21 so that a portion of wall 45, 63 of a hollow member 12, 50 is above surface 43 of soil mass 21 as shown in FIG. 2B, and one or more hollow members 12, 50 can be positioned in soil mass 21 so that a portion of wall 45, 63 of a hollow member 12, 50 is above surface 43 of soil mass 21 and wherein an extension portion 13 or 67 is coupled to hollow member 12, 50, e.g., as shown in FIG. 1A or 1B.

In another embodiment, one or more hollow members 12, 50 can be positioned in soil mass 21 so that a portion of wall 45, 63 of a hollow member 12, 50 is above surface 43 of soil mass 21 as shown in FIG. 2B, and one or more hollow members 12, 50 can be positioned in soil mass 21 so that a portion of wall 45, 63 of a hollow member 12, 50 is above surface 43 of soil mass 21 and wherein an extension portion 13 or 67 is coupled to hollow member 12, 50. In another embodiment, one or more hollow members 12, 50 including an extension portion 13 or 67 can be positioned in soil mass 21 so that a portion of wall 45, 63 of a hollow member 12, 50 is above surface 43 of soil mass 21 and wherein an extension portion 13, 67 is coupled to hollow member 12, 50, e.g., as shown in FIG. 1A or 1B.

In another embodiment, one or more hollow members 12, 50 including an extension portion 13 or 67 can be positioned in soil mass 21 so that wall 45, 63 of a hollow member 12, 50 is below surface 43 of soil mass 21 and wherein an extension portion 13, 67 is coupled to hollow member 12, 50 and extends above surface 43, e.g., as shown in FIG. 1A or 1B.

After a hollow member 12, 50 is driven into soil mass 21, a drive unit 34, 37 or 65 can be uncoupled from hollow member 12, 50. An extension portion 13, 67 can thereafter be coupled to a hollow member 12, 50, by a keyed slot formed into the concrete or other embedded materials, e.g., a metal keyed slot. An extension portion 13, 67 can be coupled to hollow member 12, 50 manually or with use of machinery that can pick up extension portion 13, 67, place extension portion 13, 67 on hollow member 12, 50, wherein a pin 28 or a lift anchor 76 is inserted into a keyed slot or into slots 30 or 32, and rotated to lock. If desired, rocks, gravel, sediment or other materials can be poured into an open upper portion of a hollow member 12, 50 or extension portion 13, 67 that is extending above surface 43. Vegetation 20 or other desired materials, natural or synthetic, can also be added to an upper portion of hollow member 12, 50 or extension portion 13, 67, e.g., to blend the hollow members 12, 50 with the surrounding landscape or environment.

Preferably a hollow member 12 or 50 is driven into the ground, waterbed, soil, sand, sediment, clay, or other earthen material at a depth that will provide stabilization to the earthen material, e.g., 4 feet below the surface, or about 2 to 6 feet below the surface. Preferably, a hollow member 12 or 50 is driven substantially straight and to a depth at which the hollow member 12 or 50 can remain straight even if subjected to wave action. In some embodiments, a hollow member 12 or 50 can be driven to a depth that is over 6 feet below the surface, e.g., about 6 to 12 feet or more below the surface.

In various embodiments, when using additional soft or hard top or extension portions 13, the bottom hollow member 12 or 50 can be driven approximately one foot below the earth surface 43. When using just a single hollow member 12 or 50, a hollow member upper portion/top 24 or 71 can be about flush with the earth surface 43, or can be just below the earth surface 43, or can extend a distance above the earth surface 43. When using a single hollow member 12 or 50 with an extension portion 67, a hollow member upper portion/top 24 or 71 can be about flush with the earth surface 43, or can be just below the earth surface 43, or can extend a distance above the earth surface 43 with extension portion 67 extending above the earth surface 43. When using a single hollow member 12 or 50 with an extension portion 67, a hollow member upper portion/top 24 or 71 can be a desired distance below earth surface 43, with top 68 of extension portion 67 about flush with the earth surface 43, or just below the earth surface 43, or extending a desired distance above the earth surface 43.

As discussed, although concrete is the preferred material for a hollow member, jar or pile used in one or more preferred embodiments of the system and method of the present invention, a hollow member, jar or pile can also be formed from other similar materials currently available or to be developed in the future. For example, other mixtures or compositions of earth materials, e.g., minerals, rocks, soil, clay, water, plant fibers, etc., and/or other mixtures or compositions including synthetic materials, e.g., acrylic, aramid, carbon, nylon, polyester, polyethylene, that can be spread or poured into molds and that can form a stonelike mass on hardening can be used.

In some embodiments, mixtures or compositions can include metals, minerals, clay, hemp, saw dust, steel dust, fly ash, straw, broken stone or gravel, sand, cement, and/or water or other fluid, and/or other similar materials that can be spread or poured into molds and that can form a stonelike mass on hardening can be used. Fiber reinforced concrete can also be used, e.g., with fibers including steel fibers, glass fibers, synthetic fibers, natural fibers and/or one or more of the materials listed above.

The following is a list of parts and materials suitable for use in the present invention:

PARTS LIST:

| PART NUMBER | DESCRIPTION |
|---|---|
| 10 | earth/ground/soil stabilization system |
| 11 | earth/ground/soil stabilization system |
| 12 | hollow member/pile/jar |
| 13 | extension portion/extension/top portion |
| 14 | base cutter portion/base cutter |
| 15 | teeth/cutters |
| 16 | bottom |
| 17 | opening/central bore/borehole |
| 18 | opening/central bore/borehole |
| 19 | hole/opening |
| 20 | vegetation |
| 21 | soil mass/ground material/earthen material/seabed/ waterbed |
| 22 | water |
| 23 | arrow |
| 24 | upper portion/top |
| 25 | reinforcer/reinforcing bar/rebar |
| 26 | reinforcer/reinforcing bar/rebar |
| 27 | bottom/bottom portion |
| 28 | lift, turn, drive, connecting pin |
| 29 | nelson pin/stud/bolt |
| 30 | slot/lock |
| 31 | weld |
| 32 | slot/lock |
| 33 | narrower portion |
| 34 | turning tool/drive unit |
| 35 | notch |
| 36 | larger portion/wider opening |
| 37 | turning tool/drive unit |
| 38 | top |
| 39 | bottom |
| 40 | top |
| 41 | bottom |
| 42 | slope/sloped portion |
| 43 | surface/earth surface/seabed surface/waterbed surface/ground surface |
| 44 | water surface |
| 45 | wall/side wall |
| 46 | wall/side wall |
| 47 | concrete |
| 48 | base cutter portion/base cutter |
| 49 | opening/bore |
| 50 | hollow member/pile/jar |
| 51 | top/head of pin |
| 52 | crane |
| 53 | narrow portion |
| 54 | wider portion |
| 55 | ring, e.g., metal |

-continued

PARTS LIST:

| PART NUMBER | DESCRIPTION |
|---|---|
| 56 | opening/bore |
| 57 | space |
| 58 | coupler/crane coupler |
| 59 | cutter/teeth |
| 60 | wall |
| 61 | notch |
| 62 | block |
| 63 | wall/sidewall |
| 64 | longitudinal portion |
| 65 | turning tool/drive unit |
| 66 | bottom surface |
| 67 | extension portion/extension/top portion |
| 68 | upper portion/top |
| 71 | upper portion/top |
| 73 | bottom/bottom portion |
| 75 | opening |
| 76 | lift anchor/dog bone |
| 77 | top/head |
| 78 | bottom/anchor |
| 79 | longitudinal portion |

The invention claimed is:

1. An earth stabilization system comprising:

a) a plurality of members that are hollow and positioned within a soil mass to be stabilized, each of the plurality of members having a height, a weight, a side wall having a side wall top and a side wall bottom, and a substantially central bore extending from the side wall bottom to the side wall top, the wall formed from material including concrete;

b) the side wall of each of the plurality of members having a wall thickness and a reinforcing material within the side wall;

c) a base cutter including a plurality of teeth coupled to each of the plurality of members at or near each side wall bottom, wherein the base cutter includes at least one material other than concrete;

d) each side wall top having a coupler enabling attachment of each of the plurality of hollow members to a drive unit, the drive unit operable to cause rotation of the member;

e) each said member rotatable with the drive unit, wherein rotation of the drive unit affects rotation of each said member and the base cutter; and f) wherein the weight of each said member at least in part facilitates each said member's penetration of the soil mass during rotation, and wherein displaced soil can move through the bore in a direction of the side wall bottom to the side wall top during rotation.

2. The system of claim 1 wherein the base cutter of at least one member of the plurality of members is welded to the reinforcing material.

3. The system of claim 1 wherein the base cutter of at least one member of the plurality of members includes a stud or bolt, and wherein the stud or bolt is embedded in the side wall of the at least one member.

4. The system of claim 1 wherein the side wall of at least one member of the plurality of members is formed from a polymeric concrete material, a polymer-modified concrete material, reinforced concrete, or a material including Portland cement.

5. The system of claim 1 wherein some of the plurality of members are positioned in the soil mass at a depth wherein the side wall top is covered by the soil, and some of the plurality of members are positioned in the soil mass at a depth wherein the side wall top extends a distance above the soil mass.

6. The system of claim 5 wherein an upper portion is coupled to each side wall top of said members that extends above the soil.

7. The system of claim 6 wherein the upper portion is truncated.

8. The system of claim 6 wherein the upper portion includes vegetation or other materials for blending an appearance of the upper portion with a surrounding environment.

9. The system of claim 6 wherein the upper portion includes one or more openings, the one or more openings adapted to allow water or sediment to flow therethrough.

10. The system of claim 1 wherein the wall thickness of each side wall of each said member is between 4 and 14 inches.

11. The system of claim 1 wherein at least one of the side walls of at least one of the plurality of members has a notched interior surface that is adapted to lift, move, or displace the soil while the at least one member is being rotated and screwed into the soil mass.

12. The system of claim 1 wherein the base cutter of at least one member of the plurality of members includes a combination of concrete, steel, and diamond introduced into a concrete pour.

13. The system of claim 1 wherein a stud is welded to the base cutter with concrete poured over the stud and at least a portion of the base cutter when forming at least one member of the plurality of members.

14. The system of claim 1 wherein the base cutter of at least one member of the plurality of members is connected to the reinforcing material.

15. An earth stabilization system for stabilizing a soil mass comprising:

a) a plurality of hollow jars positioned within a soil mass to be stabilized, each said jar having a weight, a wall with a wall top and a wall bottom, and a bore extending from the wall bottom to the wall top, the wall formed from a material that can be poured and that hardens when set;

b) the wall of each said jar having a wall thickness and a reinforcing material within the wall;

c) a base cutter portion formed as part of the wall bottom of each said jar;

d) a turning tool;

e) each wall top having a coupler enabling attachment of each said jar to a turning tool, the turning tool operable to rotate each said jar;

f) wherein the turning tool enables rotation of each said jar and the base cutter portion;

g) wherein the weight of each said jar at least in part enables each said jar to cut through the soil mass, and wherein displaced soil can move through the bore in the wall while each said jar is being rotated into the soil mass in the direction of the wall bottom to the wall top; and h) wherein the base cutter portion of at least one jar of the plurality of hollow jars is made from a same material as the wall of the at least one jar, and wherein the same material is reinforced concrete.

16. The system of claim 15 wherein the base cutter portion of the at least one jar additionally includes at least one material that is not concrete, the at least one material selected from the following group: steel, metal, glass, diamond tips, and carbide tips.

17. An earth stabilization system for stabilizing a soil mass comprising:

a) a plurality of hollow jars positioned within a soil mass to be stabilized, each said jar having a weight, a wall with a wall top and a wall bottom, and a bore extending from the wall bottom to the wall top, the wall formed from a material that can be poured and that hardens when set;

b) the wall of each said jar having a wall thickness and a reinforcing material within the wall;

c) a base cutter portion formed as part of the wall bottom of each said jar;

d) a turning tool;

e) each wall top having a coupler enabling attachment of each said jar to a turning tool, the turning tool operable to rotate each said jar;

f) wherein the turning tool enables rotation of each said jar and the base cutter portion;

g) wherein the weight of each said jar at least in part enables each said jar to cut through the soil mass, and wherein displaced soil can move through the bore in the wall while each said jar is being rotated into the soil mass in the direction of the wall bottom to the wall top; and h) wherein the wall thickness of each of the plurality of hollow jars is between 3 and 14 inches.

* * * * *